US010046938B2

(12) United States Patent
Komiyama et al.

(10) Patent No.: US 10,046,938 B2
(45) Date of Patent: Aug. 14, 2018

(54) APPARATUS FOR PROCESSING SHEET BUNCHES AND SYSTEM FOR FORMING IMAGES PROVIDED WITH THE APPARATUS

(71) Applicants: Daiki Komiyama, Yamanashi-ken (JP); Takashi Saito, Yamanashi-ken (JP); Isao Kondo, Yamanashi-ken (JP)

(72) Inventors: Daiki Komiyama, Yamanashi-ken (JP); Takashi Saito, Yamanashi-ken (JP); Isao Kondo, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 75 days.

(21) Appl. No.: 15/192,219

(22) Filed: Jun. 24, 2016

(65) Prior Publication Data

US 2016/0376121 A1 Dec. 29, 2016

(30) Foreign Application Priority Data

Jun. 25, 2015 (JP) ..... 2015-128067
Jun. 25, 2015 (JP) ..... 2015-128068

(51) Int. Cl.
*B65H 37/04* (2006.01)
*B31F 5/02* (2006.01)
(Continued)

(52) U.S. Cl.
CPC ..... *B65H 37/04* (2013.01); *B31F 5/02* (2013.01); *B65H 31/02* (2013.01);
(Continued)

(58) Field of Classification Search
CPC ..... B65H 37/04; B65H 31/30; B65H 31/28; B65H 9/10; B65H 9/101; B65H 9/06;
(Continued)

(56) References Cited

U.S. PATENT DOCUMENTS 8,104,759 B2 * 1/2012 Kawaguchi ..... B65H 7/00 270/58.08
8,113,513 B2 * 2/2012 Funada ..... B65H 9/106 270/58.12

(Continued)

FOREIGN PATENT DOCUMENTS

JP 2011-190021 A 9/2011
JP 2013-149859 A 8/2013

*Primary Examiner* — Leslie A Nicholson, III
(74) *Attorney, Agent, or Firm* — Manabu Kanesaka

(57) ABSTRACT

In order to enable a press-bound sheet bunch to be easily peeled away from press teeth, the present invention is to provide a sheet bunch processing apparatus with a needle-less binding apparatus which includes a pair of press tooth members where a plurality of press teeth extending in a ridge-line direction is formed parallel, presses a part of a sheet bunch between the pair of press tooth members, and thereby performs press binding processing, and with a peeling mechanism which applies a force in a direction substantially parallel with the ridge-line direction of the press teeth to the sheet bunch, and thereby peels the sheet bunch subjected to the press binding processing away from the press teeth of the press tooth members.

15 Claims, 20 Drawing Sheets

(51) Int. Cl.

| | |
|---|---|
| ***G03G 15/00*** | (2006.01) |
| ***B65H 31/02*** | (2006.01) |
| ***B65H 31/30*** | (2006.01) |
| ***B65H 31/36*** | (2006.01) |
| ***B65H 31/38*** | (2006.01) |

(52) U.S. Cl.
CPC ..... *B65H 31/3081* (2013.01); *B65H 31/36* (2013.01); *B65H 31/38* (2013.01); *G03G 15/6541* (2013.01); *B65H 2301/4212* (2013.01); *B65H 2301/4213* (2013.01); *B65H 2403/942* (2013.01); *B65H 2404/153* (2013.01); *B65H 2404/1521* (2013.01); *B65H 2404/1523* (2013.01); *B65H 2801/27* (2013.01)

(58) Field of Classification Search
CPC ..... B65H 2301/36; B65H 2301/51616; B65H 2301/43828; B65H 2408/114; B31F 1/07; B31F 5/02; B31F 2201/0712; G03G 2215/00852
USPC ..... 270/58.07, 58.08, 58.12, 58.17, 58.27
See application file for complete search history.

(56) References Cited

U.S. PATENT DOCUMENTS

| | | | | |
|---|---|---|---|---|
| 9,278,571 | B2 * | 3/2016 | Abe | B65H 37/04 |
| 2014/0353900 | A1 * | 12/2014 | Abe | B42B 5/00 270/58.08 |
| 2015/0003938 | A1 * | 1/2015 | Morinaga | B42C 13/00 412/11 |
| 2015/0014384 | A1 * | 1/2015 | Obuchi | B27F 7/17 227/99 |
| 2015/0014385 | A1 * | 1/2015 | Obuchi | B42C 1/12 227/99 |
| 2015/0014386 | A1 * | 1/2015 | Obuchi | G03G 21/1633 227/100 |
| 2015/0014913 | A1 * | 1/2015 | Obuchi | B65H 31/36 270/58.12 |
| 2015/0021374 | A1 * | 1/2015 | Kubo | B65H 37/04 227/39 |
| 2015/0021844 | A1 * | 1/2015 | Kubo | B31F 5/001 270/1.01 |
| 2015/0093214 | A1 * | 4/2015 | Takahashi | B42B 5/00 412/33 |

* cited by examiner

B-B ENLARGED CROSS SECTION

APPARATUS FOR PROCESSING SHEET BUNCHES AND SYSTEM FOR FORMING IMAGES PROVIDED WITH THE APPARATUS

RELATED APPLICATIONS

The present application is based on, and claims priority from, Japanese Applications No. JP2015-128067 filed Jun. 25, 2015; and No. 2015-128068 filed Jun. 25, 2015, the disclosure of which is hereby incorporated by reference herein in its entirety.

TECHNICAL FIELD

The present invention relates to a sheet bunch processing apparatus for collecting a plurality of sheets fed from an image formation apparatus and the like in the shape of a bunch to perform binding processing, and an image formation system provided with the apparatus.

BACKGROUND ART

Generally, as a sheet bunch processing apparatus (post-processing apparatus) is widely known an apparatus which collects a plurality of sheets discharged from an image formation apparatus on a processing tray, performs post-processing such as binding processing with a binding processing apparatus, and carries out to a stack tray on the downstream side to store. Further, an apparatus for performing binding processing with staples is widely used, as the binding processing apparatus used in such a sheet bunch processing apparatus. However, since sheets are not peeled easily and there is also the problem processing bound documents (shredder cutting and the like), various binding processing apparatuses have been proposed which do not use metal needles.

For example, Patent Document 1 discloses a sheet bunch processing apparatus configured to collect sheets on a processing tray from a sheet discharge outlet of an image formation apparatus, and cause an operator to select whether to perform staple binding processing or perform needleless binding processing on the sheet bunch. The needleless binding processing in the sheet bunch processing apparatus as disclosed in Patent Document 1 is performed by the so-called press binding processing for using the apparatus (hereinafter, described as needleless binding apparatus) having a pair of concavo-convex-shaped pressurizing surfaces that mutually mesh, nipping a sheet bunch between a pair of pressurizing surfaces to bring into press intimate contact, and thereby binding the sheet bunch. More specifically, the needleless binding processing is performed by transporting a sheet bunch in a direction (sheet width direction) orthogonal to a sheet discharge direction to position in between a pair of pressurizing surfaces, performing the press binding processing on the sheet bunch, and then, carrying out the sheet bunch in the same direction as the sheet discharge direction.

PRIOR ART DOCUMENT

Patent Document

[Patent Document 1] Japanese Patent Application Publication No. 2011-190021

[Patent Document 2] Japanese Patent Application Publication No. 2015-20339

DISCLOSURE OF INVENTION

Problems to be Solved by the Invention

In performing the press binding processing, since a sheet bunch is pressed strongly against a pair of press tooth members having a plurality of press teeth extending parallel in the ridge-line direction i.e. a pair of concavo-convex-shaped pressurizing surfaces, such a problem may occur that the sheet bunch is in a state of biting into press teeth of one of the pair of press tooth members.

In order to prevent such a problem from occurring, a sheet bunch processing apparatus is proposed where a sheet bunch is carried out after performing peeling processing for peeling the sheet bunch subjected to press binding away from press teeth. For example, in a sheet bunch binding processing apparatus as disclosed in Patent Document 2, using one of a pair of alignment plates for width-aligning from the width direction (direction perpendicular to the carrying-out direction of a sheet bunch) of the sheet bunch and placing the sheet bunch in beforehand determined posture and position before the press binding processing, the sheet bunch is kicked in a direction crossing the carrying-out direction of the sheet bunch from a binding position after the press binding processing, is offset by a predetermined amount to peel the sheet bunch away from press teeth, and then, is transported in the carrying-out direction.

However, the needleless binding apparatus is often disposed so that the ridge-line direction of press teeth is arranged to extend obliquely with respect to the carrying-out direction. Therefore, as in the sheet bunch binding processing apparatus disclosed in Patent Document 2, in the method of peeling a sheet bunch away from press teeth by shifting the sheet bunch in the direction crossing the carrying-out direction, since the method makes a form for peeling the bite between a plurality of press teeth of the press tooth members and the sheet bunch at the same time in the direction crossing the ridge-line direction of each of the press teeth, resistance is large, and a large force is required to peel off. Therefore, there is a possibility of causing a loss of synchronization and transport failure of a drive motor for driving the alignment plate used in the kick.

Accordingly, in order to solve the problem existing in the conventional techniques, it is an object of the present invention to enable a press-bound sheet bunch to be easily peeled away from press teeth.

Means for Solving the Problem

In view of the above-mentioned object, as Aspect 1, the present invention provides a sheet bunch processing apparatus that is a sheet bunch processing apparatus for performing post-processing on a sheet bunch obtained by collecting a plurality of sheets supplied onto a processing tray to carryout in a carrying-out direction, and is provided with a needleless binding apparatus which includes a pair of press tooth members where a plurality of press teeth extending in a ridge-line direction is formed parallel, presses apart of the sheet bunch between the pair of press tooth members, and thereby performs press binding processing, and with a peeling mechanism which applies a force in a direction substantially parallel with the ridge-line direction of the press teeth to the sheet bunch, and thereby peels the sheet bunch subjected to the press binding processing away from the press teeth of the press tooth members.

In the above-mentioned sheet bunch processing apparatus, the peeling mechanism applies the force in the direction substantially parallel with the ridge-line direction of the press teeth to the sheet bunch, the sheet bunch is shifted in the direction substantially parallel with the ridge-line direction of the press teeth, and resistance of the sheet bunch bitten into the press teeth is thereby decreased to the press teeth.

The peeling mechanism is preferably provided with a roller that rotates about a rotation axis line and that is able to come into contact and separate with/from the sheet bunch. As one Embodiment, the roller of the peeling mechanism is capable of including a tilt roller that is capable of rotating about a rotation axis line and that is disposed so that the rotation axis line extends perpendicularly to the ridge-line direction of the press teeth. Further, the roller of the peeling mechanism includes a shift roller capable of rotating about a rotation axis line and shifting in the rotation axis line direction, and rotation and a shift of the shift roller may be controlled so that a force action axis line extending in an action direction of a resultant force of a force applied to the sheet bunch by the rotation of the shift roller about the rotation axis line and a force applied to the sheet bunch by the shift of the shift roller in the rotation axis line direction is parallel with an axis line extending in the ridge-line direction of the press teeth. In this case, for example, using a rack-and-pinion mechanism, a rotation shaft of the shift roller extending in the rotation axis line direction is capable of being shifted in the rotation axis line direction.

The shift roller is disposed so that the rotation axis line extends perpendicularly to the carrying-out direction, and is capable of being configured to halt the shift after peeling the sheet bunch away from the press teeth, and carry out the sheets in the carrying-out direction by the rotation about the rotation axis line.

Moreover, the peeling mechanism further includes a first push-out member and second push-out member configured to come into contact with adjacent sides of the sheet bunch subjected to the press binding processing to apply forces in liner independent directions, and operation of the first push-out member and the second push-out member may be controlled so that a force action axis line extending in an action direction of a resultant force of a force applied to the sheet bunch from the first push-out member and a force applied to the sheet bunch from the second push-out member is parallel with an axis line extending in the ridge-line direction of the press teeth. In this case, it is preferable that the apparatus is further provided with an alignment member that comes into contact with a side of the sheets facing a direction perpendicular to the carrying-out direction to align the sheet bunch in a beforehand determined posture, and a push-out lever that comes into contact with a side of the sheet bunch positioned on the upstream side in the carrying-out direction, the alignment member forms the first push-out member, and that the push-out lever forms the second push-out member.

Further, as Aspect 2, the present invention provides an image formation system provided with an image formation apparatus for forming an image on a sheet, and further, the above-mentioned sheet bunch processing apparatus for performing post-processing on a sheet bunch obtained by collecting sheets supplied onto a processing tray from the image formation apparatus to carry out.

Advantageous Effect of the Invention

According to the sheet bunch processing apparatus and image formation system provided with the apparatus of the present invention, even when a sheet bunch bites into the press tooth member used to perform the press binding processing, the sheet bunch is shifted in the direction substantially parallel with the ridge-line direction of the press teeth so as to decrease resistance of the sheet bunch to the press teeth of the press tooth member, and it is thereby possible to peel the sheet bunch away from the press teeth by a small force.

BRIEF DESCRIPTION OF DRAWINGS

FIG. 5A illustrates a waiting state, FIG. 5B illustrates a transport state, and FIG. 5C illustrates a carrying-out state of a sheet bunch to a stack tray;

FIGS. 11A to 11C illustrate steps of aligning the sheet bunch obtained by collecting sheets carried onto the processing tray in beforehand determined position and posture, and FIGS. 11D and 11E illustrate steps of shifting the sheet bunch to a binding position;

FIG. 13A illustrates a state in which the sheet bunch subjected to press binding is brought into contact with the tilt roller and forward-backward rotation rollers, FIG. 13B illustrates a state in which peeling processing is performed, and FIG. 13C illustrates a state in which the sheet bunch is carried out with forward-backward rotation rollers;

FIGS. 11A to 11C illustrate steps of aligning the sheet bunch obtained by collecting sheets carried onto the processing tray in beforehand determined position and posture, and FIGS. 11D and 11E illustrate steps of shifting the sheet bunch to a binding position; FIG. 17A illustrates a state in which press binding processing is completed, FIG. 17B illustrates a state of performing peeling processing, FIG. 17C is a state in which forward-backward rotation rollers are moved down to actuation positions for coming into contact with the sheet bunch, and FIG. 17D illustrates a state of carrying out the sheet bunch with forward-backward rotation rollers.

BEST MODE FOR CARRYING OUT THE INVENTION

Figure 1:
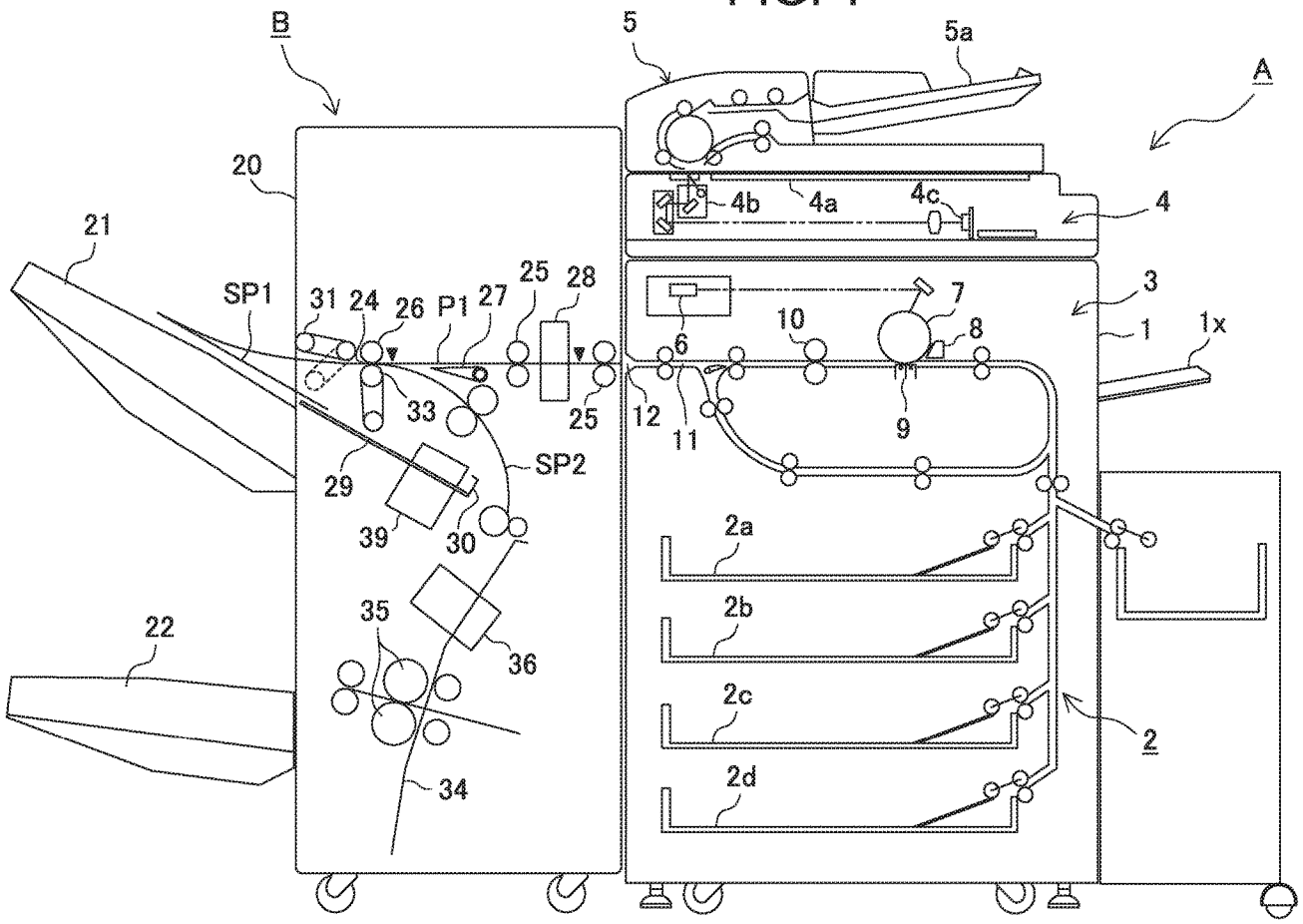
FIG. 1 is an explanatory view of an entire configuration of an image formation system according to the present invention.

Preferred Embodiments of the present invention will specifically be described below with reference to accompanying drawings. In the accompanying drawings, similar components are represented by adding the same reference numerals.

In addition, in the present description, "offset transport of a sheet bunch" means that a sheet bunch obtained by collecting sheets carried onto a processing tray from a sheet discharge outlet is shifted (width-alignment shifted) in a direction orthogonal to (or crossing) the sheet transport direction, and "offset amount" means a shift amount in the direction orthogonal to (or crossing) the sheet transport direction in offset transport of the sheet bunch. Further, "alignment of the sheet bunch" means that a sheet bunch of a plurality of sheets carried onto the processing tray from the sheet discharge outlet is placed in beforehand determined posture and position on the processing tray, according to a predetermined reference (for example, center reference that is the center position in the direction orthogonal to the sheet transport direction i.e. the width direction, or side reference set on one side in the width direction). For example, "to offset after aligning sheets" means that a plurality of sheets is placed in beforehand determined position and posture according to the aforementioned reference, and that, while keeping this state, the entire sheet bunch is then shifted in the direction orthogonal to (or crossing) the sheet transport direction.

FIG. 1 illustrates an image formation system provided with a sheet bunch processing apparatus according to the present invention. An image formation system shown in FIG. 1 includes an image formation apparatus A, and post-processing apparatus (hereinafter, described as sheet bunch processing apparatus) B and is comprised thereof, and the sheet bunch processing apparatus B collates and collects sheets with images formed in the image formation apparatus A, performs post-processing such as needleless binding on a bunch of collected sheets, and stores in a first stack tray 21 or second stack tray 22 on the downstream side. In the present description, the front side of the image formation system of FIG. 1 is referred to as the apparatus front side, and the back side is referred to as the apparatus back side.

The image formation apparatus A and sheet bunch processing apparatus B will specifically be described below.

[Image Formation Apparatus]

As shown in FIG. 1, the image formation apparatus A is provided with a paper feed section 2, image formation section 3 and image data storage section (not shown) inside a casing 1, feeds a sheet from the paper feed section 2 to the image formation section 3, forms an image on the sheet in the image formation section 3, and then, carries out the sheet from a main-body sheet discharge outlet 12.

In the Embodiment shown in the figure, the paper feed section 2 includes a plurality of cassettes 2*a*, 2*b*, 2*c*, 2*d*, and each of the cassettes 2*a*, 2*b*, 2*c*, 2*d* is capable of storing sheets of a beforehand selected different standard size. Further, the paper feed section 2 is provided with a mutual feed tray 1*x*, and is configured so that a user is capable of inserting a sheet corresponding to the intended use. For sheets set in the paper feed section 2 of such a configuration, it is configured that information on sheet conditions such as a size, paper quality (coating paper, normal paper and the like) and thickness of paper is capable of being input from a control panel 13 described later.

The image formation section 3 is only required to be configured to form an image on a sheet fed from the paper feed section 2, and is capable of adopting various image formation mechanisms. The Embodiment shown in the figure indicates an electrostatic type image formation mechanism as the image formation section 3. However, the image formation section 3 is not limited to the electrostatic type image formation mechanism shown in the figure, and is capable of adopting an inkjet type image formation mechanism, offset type image formation mechanism and the like.

As shown in FIG. 1, the image formation section 3 is provided with a light-emitting device (laser head or the like) 6, photoconductor drum 7, and development device 8, and is configured to form a latent image (static image) on the surface of the photoconductor drum 7 with the light-emitting device 6, and add toner with the development device 8. The ink image (toner ink) attached onto the photoconductor drum 7 is image-transferred to the sheet fed from the paper feed section 2 with a transfer charger 9, and the image-transferred sheet is fused with a fuse roller 10, and then, is fed to a sheet discharge path 11.

Although not shown in the figure, the image data storage section is comprised of storage memory that stores image data to form on the photoconductor drum 7 with the light-emitting device 6 of the image formation section 3, and data is transferred to the image data storage section from an image reading unit 4. Further, for example, data may be transferred to the image data storage section from a computer constituting a part of a network, or the like.

Above the image formation apparatus A thus configured is provided the image reading unit 4 for reading an original document image, and further above the image reading unit 4 is mounted an original document feed unit 5. The image reading unit 4 is provided with platen 4*a* formed of transparent glass, reading carriage 4*b*, and photoelectric converter 4*c*, reads an image of an original document sheet placed on the platen 4*a* by scanning with the scanning carriage 4*b*, converts into an electric signal with the photoelectric converter 4*c*, and stores in the image data storage section. Further, the original document feed unit 5 includes a paper feed tray 5*a*, and is configured to separate original document sheets placed on the paper feed tray 5*a* on a sheet-by-sheet basis, and automatically feed to the platen 4*a* of the image reading unit 4.

[Sheet Bunch Processing Apparatus (Post-Processing Apparatus)]

Figure 2:
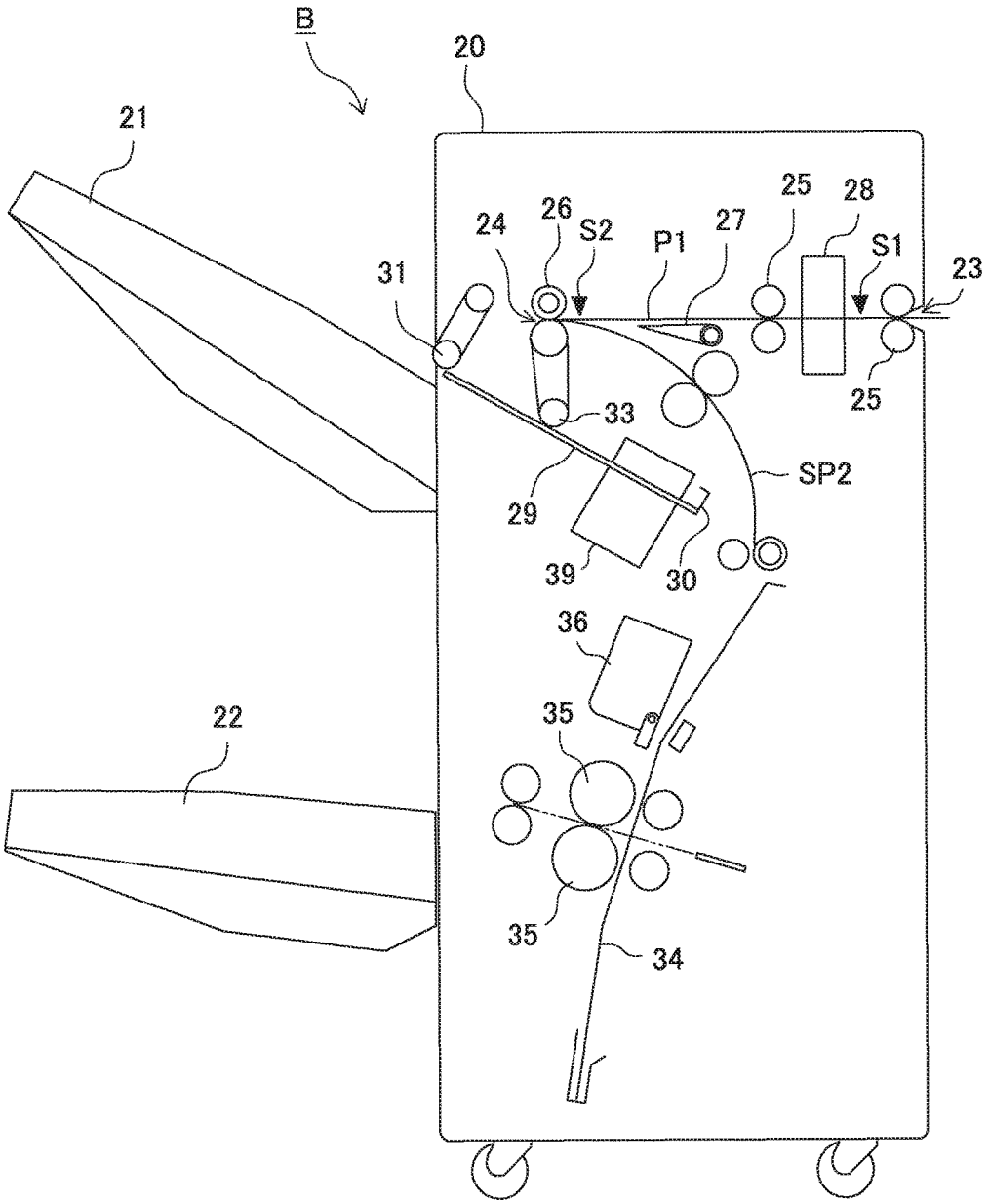
FIG. 2 is an explanatory view illustrating an entire configuration of a sheet bunch processing apparatus as a post-processing apparatus in the image formation system shown in FIG. 1.
Figure 3:
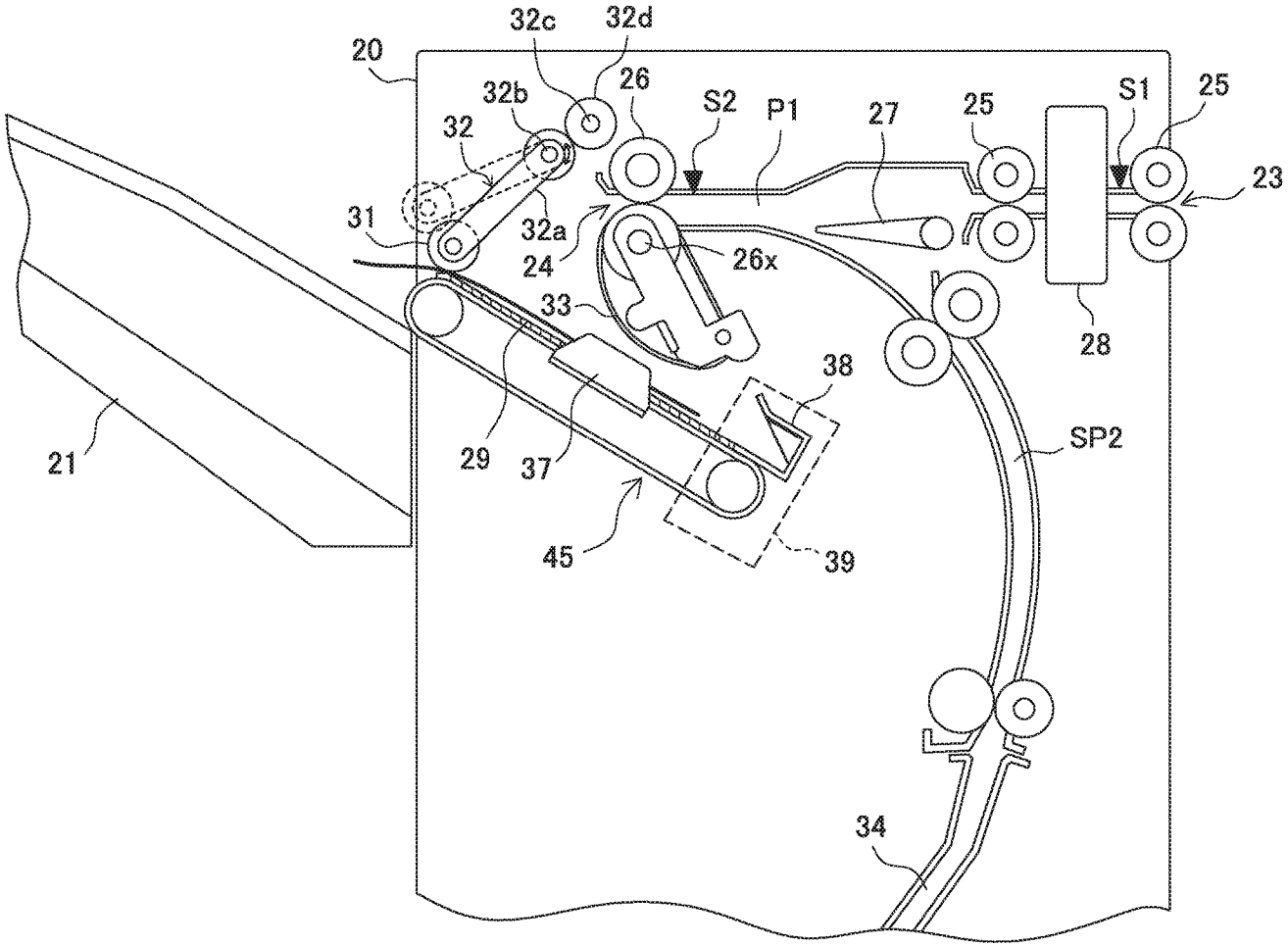
FIG. 3 is an explanatory view illustrating a part of the sheet bunch processing apparatus shown in FIG. 2.

The sheet bunch processing apparatus (post-processing apparatus) B coupled to the image formation section A is provided with an apparatus housing 20, first stack tray 21 and second stack tray 22, as the entire configuration is shown in FIG. 2, and the internal configuration is shown in FIG. 3. The apparatus B receives image-formed sheets discharged from the main-body sheet discharge outlet 12 of the image formation apparatus A, and is configured to (1) store the sheets discharged from the main-body sheet discharge outlet 12 in the first stack tray 21 without performing post-processing ("print-out mode"), (2) collate the sheets discharged from the main-body sheet discharge outlet 12 in the shape of a bunch to perform binding processing, and then, store in the first stack tray 21 ("binding mode"), or (3) collate the sheets discharged from the main-body sheet discharge outlet 12 in the shape of a bunch, and then, fold in the shape of a booklet to store in the second stack tray 22 ("sheet bunch folding mode").

Inside the apparatus housing 20 of the sheet bunch processing apparatus B is provided a sheet carry-in path P1 extending substantially linearly in the approximately horizontal direction between a carry-in entrance 23 and a sheet discharge outlet 24. As shown in FIG. 1, the carry-in entrance 23 of the sheet carry-in path P1 is disposed to be connected to the main-body sheet discharge outlet 12 of the image formation apparatus A, and is capable of carrying the sheet discharged from the main-body sheet discharge outlet 12 to the inside of the sheet bunch processing apparatus B via the sheet carry-in path P1. Further, inside the apparatus housing 20 are provided a first switchback transport path SP1 and second switchback transport path SP2 branched off from the sheet carry-in path P1 to carry the sheet in the reverse direction, the first switchback transport path SP1 is disposed on the downstream side (apparatus back end side) from the sheet carry-in path P1, and the second switchback transport path SP2 is disposed on the upstream side from the first switchback transport path SP1. Further, on the downstream side of the sheet discharge outlet 24 of the sheet carry-in path P1, a processing tray 29 is disposed below with a height difference apart from the sheet discharge outlet 24.

[Sheet Carry-In Path]

Figure 4:
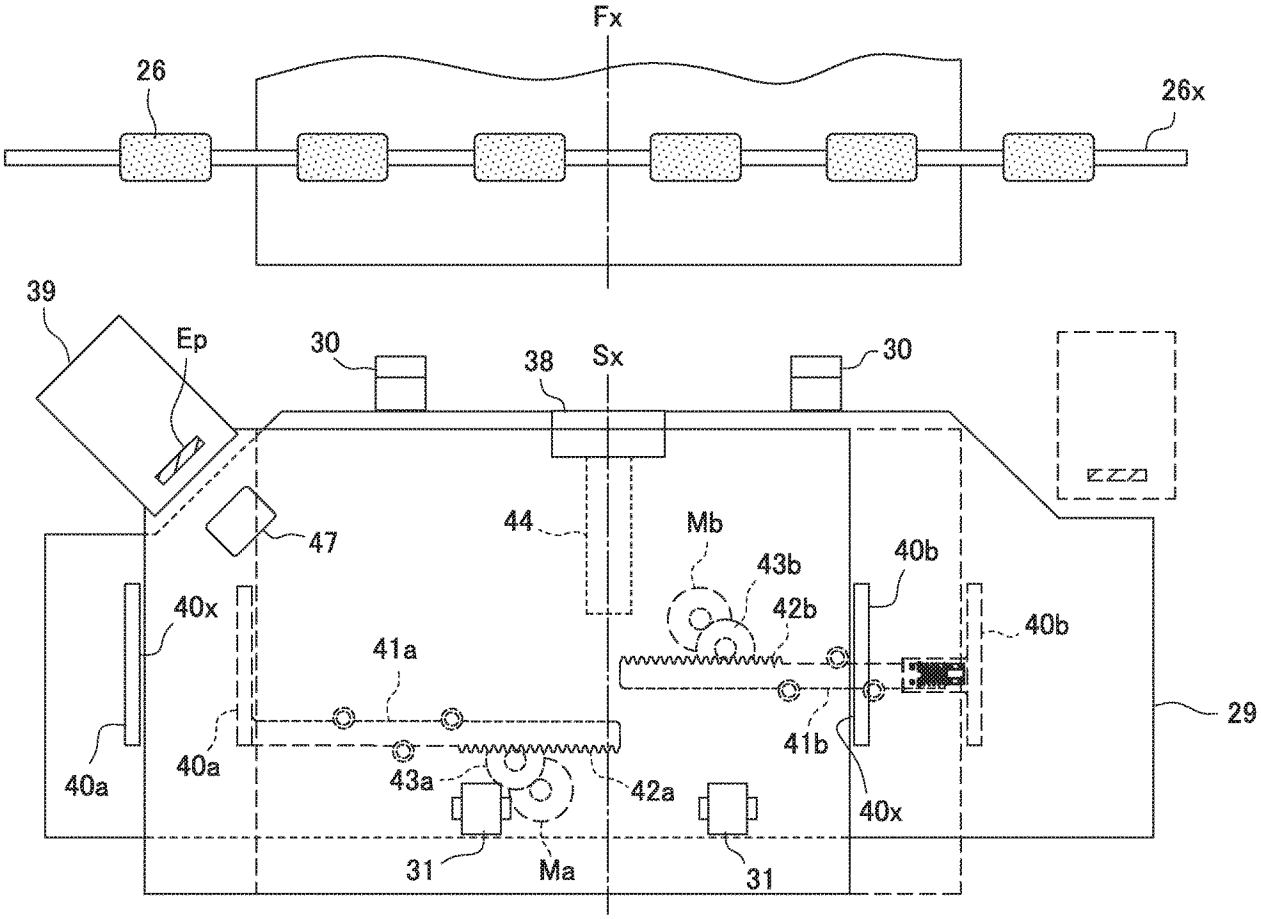
FIG. 4 is an explanatory view in viewing a processing tray of the sheet bunch processing apparatus shown in FIG. 2 from above.

The sheet carry-in path P1 is provided with carry-in rollers 25 that transport a sheet received from the carry-in entrance 23 toward the sheet discharge outlet 24, and a sheet discharge roller 26 provided in an exit end of the carry-in path P1 to discharge the transported sheet from the sheet discharge outlet 24, and these rollers are configured to be driven by forward-backward rotation capable drive motors (not shown). Further, in the vicinities of the carry-in entrance 23 and sheet discharge outlet 24 of the sheet carry-in path P1 are respectively provided an entrance sensor S1 and exit sensor S2 that detect the front end and/or rear end of the sheet. As shown in FIG. 1, the carry-in roller 25 may be provided in a plurality of portions along the sheet carry-in path P1. As shown in FIG. 4, the sheet discharge roller 26 has a configuration that a pair of roller units with a plurality of roller bodies disposed at predetermined intervals on a drive shaft 26*x* are brought into press-contact with each other, and the carry-in roller 25 also has the same configuration. The carry-in roller 25 and sheet discharge roller 26 having such a configuration are set for "sheet discharge reference position Fx" (see FIG. 4) so as to carry out sheets of different width sizes in a center reference or side reference, in carrying the sheet from the carry-in entrance 23 to the sheet discharge outlet 24 along the sheet carry-in path P1. It is preferable that the sheet discharge reference position Fx is set to coincide with a sheet transport reference of the image formation apparatus A positioned on the downstream side.

In the sheet carry-in path P1, a path switch piece 27 to guide the sheet to the second switchback transport path SP2 is disposed, and is configured to be driven by an actuation means (not shown) such as a solenoid. Further, on the sheet carry-in path P1 is provided a post-processing unit 28 for performing post-processing such as stamping (stamp means) and punching (punch means) on the sheet. In the Embodiment shown in the figure, the post-processing unit 28 is disposed in the vicinity of the carry-in entrance 23 of the sheet carry-in path P1 to be attachable/detachable to/from the apparatus housing 20 corresponding to apparatus specifications.

[First Switchback Transport Path]

The first switchback transport path SP1 provided on the downstream side of the sheet carry-in path P1 is configured as described next. In the sheet carry-in path P1, the sheet discharge roller 26 and sheet discharge outlet 24 are provided at the exit end thereof, and on the downstream side of the sheet discharge outlet 24, the processing tray 29 is provided below with the height difference apart from the sheet discharge outlet 24. The processing tray 29 is comprised of a tray to load and support a plurality of sheets discharged from the sheet discharge outlet 24.

As shown in FIGS. 3 and 4, the processing tray 29 is provided with regulating members 30 that regulate a position of a side of the sheet, which is carried in the processing tray 29, on the front side in the sheet carry-in direction, and as a transport mechanism for transporting the sheet on the processing tray 29 are provided forward/backward rotation rollers 31 disposed above the processing tray 29, a swing shift mechanism 32 to perform swing and shift described later of the forward/backward rotation rollers 31, and a take-in rotating body 33.

The regulating member 30 is comprised of a channel member substantially in the shape of a C in cross section, as in a push-out lever 38 described later, and on the inner side thereof, has a regulating surface that comes into contact with the front end in the carry-in direction of the sheet transported on the processing tray 29 to halt.

The forward/backward rotation rollers 31 are provided in the vicinity of the front end portion (end portion on the first stack tray 21 side) of the processing tray 29 in the carrying-out direction, and as shown in FIG. 4, and are disposed symmetrically each to the left or right of the center reference Sx. Further, the forward/backward rotation roller 31 is disposed above the processing tray 29, and is capable of moving up and down between an actuation position for contacting the uppermost sheet on the processing tray 29 and a waiting position separated from the uppermost sheet on the processing tray 29, while being capable of shifting in the rotation axis line direction (in the Embodiment shown in the figure, the direction perpendicular to the carrying-out direction of a sheet bunch from the processing tray 29) of the forward/backward rotation roller 31, by the swing shift mechanism 32.

Figure 7:
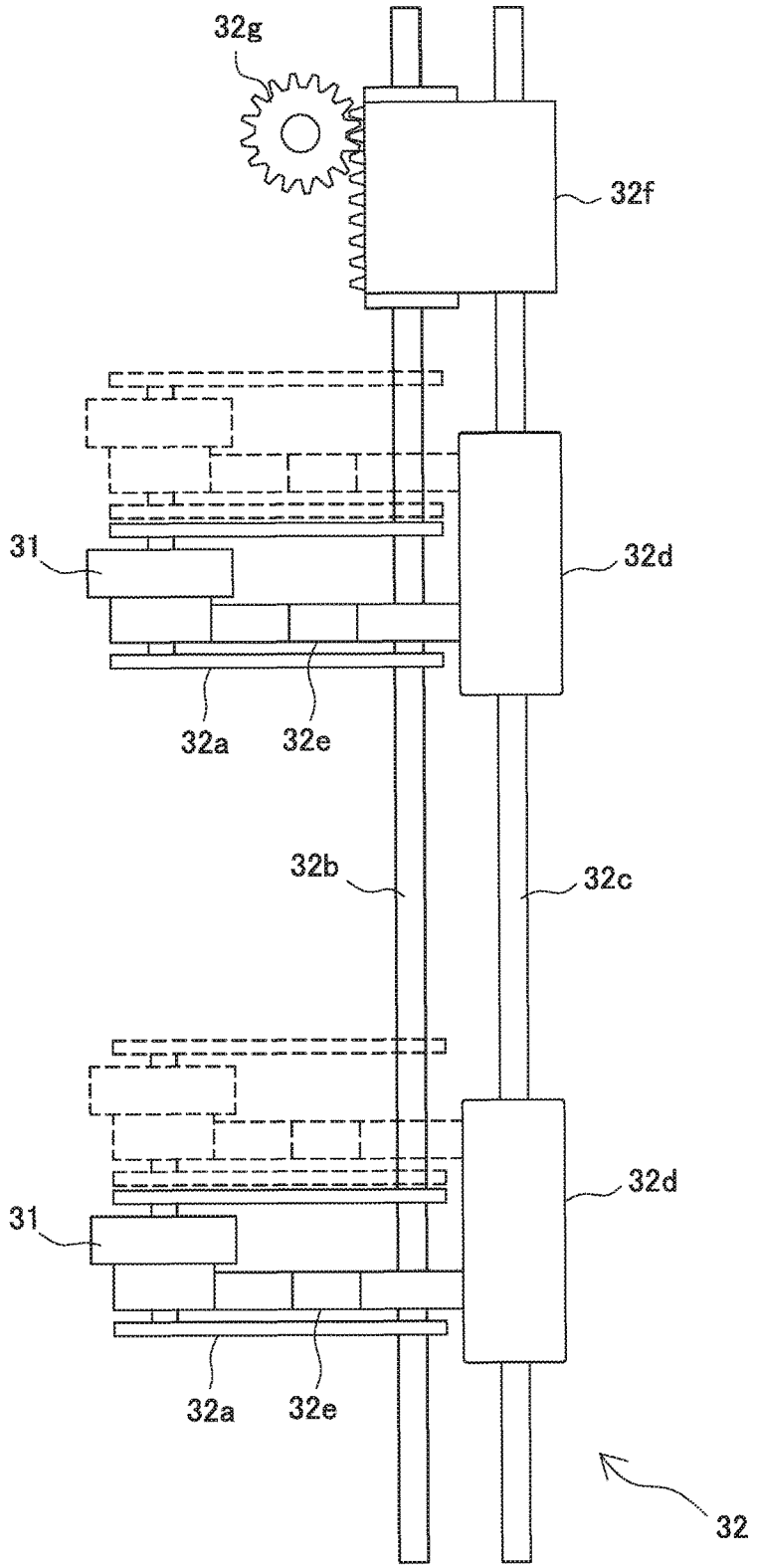
FIG. 7 is an explanatory view illustrating a configuration of forward-backward rotation rollers as a shift roller of a peeling mechanism and their swing shift mechanism.

As shown in FIG. 7, the swing shift mechanism 32 includes a swing drive shaft 32*b* supported rotatably by the apparatus frame (not shown), brackets 32*a* fixed at the base end portion to the swing drive shaft 32*b* to be swingable about the swing drive shaft 32*b*, a rotation drive shaft 32*c* supported rotatably by the apparatus frame (not shown), rotation drive gears 32*d* fixed to the rotation drive shaft 32*c*, transmission gears 32*e* supported rotatably by the brackets 32*a*, a rack 32*f* attached to the swing rotation shaft 32*b*, and a pinion 32*g* that engages in the rack 32*f*, and the forward/backward rotation roller 31 is rotatably supported on the front end portion of the bracket 32*a*. In the Embodiment shown in the figure, the swing drive shaft 32*b* and rotation drive shaft 32*c* are disposed to extend in the direction perpendicular to the carrying-out direction of a sheet bunch from the processing tray 29 i.e. the width direction of the sheet bunch on the processing tray 29.

The base end portion of the bracket 32*a* is fixed to the swing drive shaft 32*b*, and it is configured that the bracket 32*a* is swung a predetermined angle about the swing drive shaft 32*b* by rotating the swing rotation shaft 32*b* forward/backward using a swing motor not shown, and that in association therewith, the forward/backward rotation roller 31 is moved up and down between the actuation position and a swing position. Further, the rotation drive gear 32*d* is fixed to the rotation drive shaft 32*c*, and is configured to rotate in conjunction with the rotation drive shaft 32*c*. The rotation drive gear 32*d* meshes with the transmission gear 32*e*, and when the rotation drive shaft 32*c* is rotated in the forward/backward rotation direction with the forward/backward rotation motor not shown, it is configured that the forward/backward rotation roller 31 is rotated forward/backward via the rotation drive gear 32*d* and transmission gear 32*e*.

The swing drive shaft 32*b* and rotation drive shaft 32*c* extend while penetrating the rack 32*f*, and the rack 32*f* is attached to the swing drive shaft 32*b* so as to permit rotation of the swing rotation shaft 32*b* and rotation drive shaft 32*c* with respect to the rack 32*f*, while not permitting a shift of the swing drive shaft 32*b* with respect to the rack 32*f* in the rotation axis line direction of the swing drive shaft 32*b*. In addition, in the Embodiment shown in the figure, the rack 32*f* is configured to permit a shift in the rotation axis line direction of the rotation drive shaft 32*c* with respect to the rack 32*f*. Accordingly, when the pinion 32*g* engaging in the rack 32*f* is rotated with a shift drive motor not shown, the swing drive shaft 32*b* shifts in the rotation axis line direction thereof with respect to the rotation drive shaft 32*c*, and in association therewith, the forward/backward rotation roller 31 supported by the bracket 32*a* shifts in the rotation axis line direction of the swing rotation shaft 32*b* i.e. the direction perpendicular to the sheet discharge direction. In addition, in order to transfer forward/backward rotation of the rotation drive shaft 32*c* to the forward/backward rotation roller 31 when the forward/backward rotation roller 31 shifts by a required distance, the rotation drive gear 32*d* has a sufficient width (length in the rotation axis line direction) required to maintain mesh between the rotation drive gear 32*d* and the transmission gear 32*e* when the transmission gear 32*e* supported by the bracket 32*a* shifts in the rotation axis line direction by a distance required with respect to the rotation drive shaft 32*c*, in association with the shift of the swing drive shaft 32*b* in the rotation axis line direction.

In causing the sheet to enter onto the processing tray 29, thus configured forward/backward rotation rollers 31 shift to receiving positions (for example, waiting positions) separated from the processing tray 29, and when the rear end of the sheet in the travel direction reaches onto the processing tray 29, are controlled to move down to actuation positions to rotation in a direction (counterclockwise direction in FIG. 3) for transporting the sheet toward the regulating member 30 in a state brought into contact with the upper surface of the uppermost sheet on the processing tray 29. Further, as described later, in peeling processing, the forward/backward rotation roller 31 is controlled to move down to the actuation position, rotate in a direction (clockwise in FIG. 3) for carrying out a sheet bunch while shifting in its rotation axis line direction, and apply a force in the ridge-line direction of press teeth to the sheet bunch on the processing tray 29.

In the Embodiment shown in the figure, the take-in rotating body 33 is comprised of an endless belt looped between two pulleys, and one of the pulleys rotates together with the drive shaft 26*x* of the lower discharge roller 26, and is axially supported swingably so that the other pulley hangs onto the processing tray 29 about the center axis line of the pulley that is same axis as the drive shaft 26*x*. The take-in rotating body 33 engages in the upper surface of a new sheet transported onto the sheet in the uppermost position of a sheet bunch loaded on the processing tray 29, rotates counterclockwise in FIG. 3 while pressing the front end of the sheet, and feeds the sheet to the regulating member 30 until the sheet comes into contact therewith. By this means, it is possible to cancel curl and skew of the sheet that may occur for a period during which the sheet is transported to the regulating member 30 on the processing tray 29. The take-in rotating body 33 is not limited to the belt, and may be comprised of a paddle member, roller and the like.

In thus configured first switchback transport path SP1, the sheet discharged from the sheet discharge outlet 24 shifts toward the first stack tray 21 on the processing tray 29, and after the rear end of the sheet in the travel direction is discharged from the sheet discharge outlet 24 and arrives at the processing tray 29, is switchback-transported toward the regulating member 30 in a direction (hereinafter, also described as "carry-in direction") opposite to the direction (hereinafter, also described as "carrying-out direction") toward the first stack tray 21 by the forward/backward rotation roller 31 rotating counterclockwise in FIG. 3. At this point, the take-in rotating body 33 feeds the sheet along the processing tray 29 until the sheet comes into contact with the regulating member 30, in cooperation with the forward/backward rotation roller 31.

[Second Switchback Transport Path]

As shown in FIG. 1, the second switchback transport path SP2 branched off from the sheet carry-in path P1 extends substantially in the vertical direction, and on the downstream side of the second switchback transport path SP2, a collection guide 34 is provided to collate and collect sheets fed from the second switchback transport path SP2. The collection guide 34 is provided with a pair of folding rollers 35, and saddle stitch stapler 36, and it is configured that a sheet bunch collected in the collection guide 34 is bound in the center portion with the saddle stitch stapler 36, folded in the shape of a booklet with the folding rollers 35, and stored in the second stack tray 22. The saddle stitch stapler 36 and folding rollers 35 are publicly known, and since it is possible to use appropriate types, detailed descriptions thereof are omitted herein.

[Processing Tray]

As described above, on the downstream side of the sheet discharge outlet 24, the processing tray 29 is provided below with the height difference apart from the sheet discharge outlet 24. This Embodiment adopts structure (so-called bridge support structure) where the first stack tray 21 supports the front side portion in the travel direction of the sheet discharged from the sheet discharge outlet 24, and the processing tray 29 supports the rear side portion in the travel direction on the opposite side thereto, and thereby makes the entire dimensions of the processing tray 29 small in the carry-in/carrying-out direction.

In addition to the above-mentioned regulating members 30, on the processing tray 20 are further provided a side alignment mechanism 37, push-out lever 38, tilt roller 47 and binding apparatus. The regulating member 30 comes into contact with the side, on the front end side in the carry-in direction to the processing tray 29, of the sheet discharged from the sheet discharge outlet 24 onto the processing tray 29, and thereby regulates the position of the sheet in the carry-in/carrying-out direction. The side alignment mechanism 37 shifts the sheet and a sheet bunch obtained by collecting sheets on the processing tray 29 to the direction (i.e. width direction) orthogonal to the carry-in/carrying-out direction, and using the side as a reference, regulates and/or aligns the position and posture in the width direction of the sheet. The push-out lever 38 is capable of shifting in the carry-in/carrying-out direction of a sheet bunch, comes into contact with the side on the rear side in carrying-out direction of the sheet bunch on the processing tray 29, and applies a force to the sheet bunch in the direction for carrying out from the processing tray 29. The tilt roller 47 is configured to be able to move up and down between an actuation position for contacting the uppermost sheet of the sheet bunch on the processing tray 29 and a waiting position for separating from the uppermost sheet of the sheet bunch on the processing tray 29, and when the roller is moved down to the actuation position, comes into contact with the sheet bunch subjected to press binding processing to apply a force in the tilt direction with respect to the carrying-out direction to the sheet bunch. The binding apparatus performs binding processing on the sheet bunch aligned on the processing tray 29. In addition, in the Embodiment shown in the figure, as the binding apparatus, a needleless binding apparatus 39 is provided to perform the press binding processing. Further, as the binding apparatus, in addition to the needleless binding apparatus 39, a staple binding apparatus may be provided to perform binding processing using staples.

As shown in FIG. 4, the side alignment mechanism 37 includes a pair of alignment members 40*a*, 40*b* disposed to the left and right to the center reference Sx of the processing tray 29. Each of the alignment members 40*a*, 40*b* is comprised of a plate-shaped member extending vertically upward from a paper placement surface of the processing tray 29 with the inner surface mutually opposed. The inner surface of each of the alignment members 40*a*, 40*b* functions as a regulating surface 40*x* for respectively coming into contact with the close side in the width direction of the sheet on the processing tray 29 to regulate the position in the width direction of the sheet.

Each of the alignment members 40*a*, 40*b* is integrally coupled to respective one of movable support members 41*a*, 41*b* disposed on the back side of the processing tray 29 via a linear slit (not shown) in the width direction provided in the processing tray 29 to penetrate. By rotating a pinion 43*a*, 43*b* meshing with a rack 42*a*, 42*b* formed in each of the movable support members 41*a*, 41*b* respectively with a drive motor Ma, Mb individually, it is possible to shift the alignment members 40*a*, 40*b* respectively in the directions for mutually approaching or separating independently to halt in desired width-direction positions. By this means, it is possible to set the position of each of the alignment members 40*a*, 40*b* individually corresponding to the size of the sheet carried in the processing tray 29, and in shifting (offset-transporting) the sheet bunch in the width direction, it is possible to determine the position, shift amount and offset amount thereof.

Figure 5A:
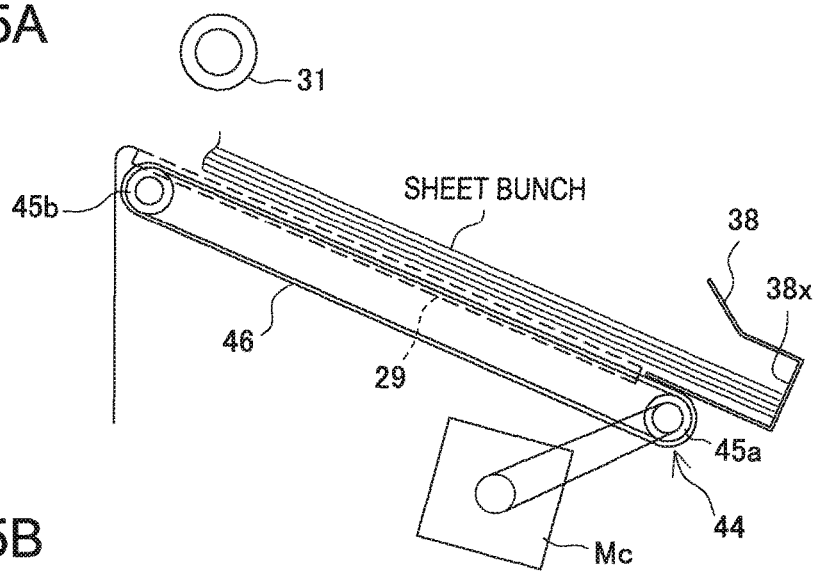
FIGS. 5A to 5C contain explanatory views of push-out lever and its drive mechanism, where
Figure 5B:
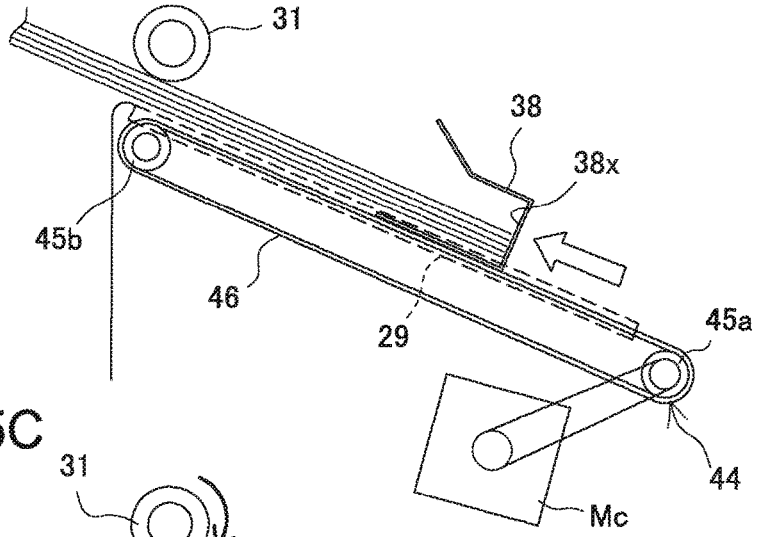
Figure 5C:
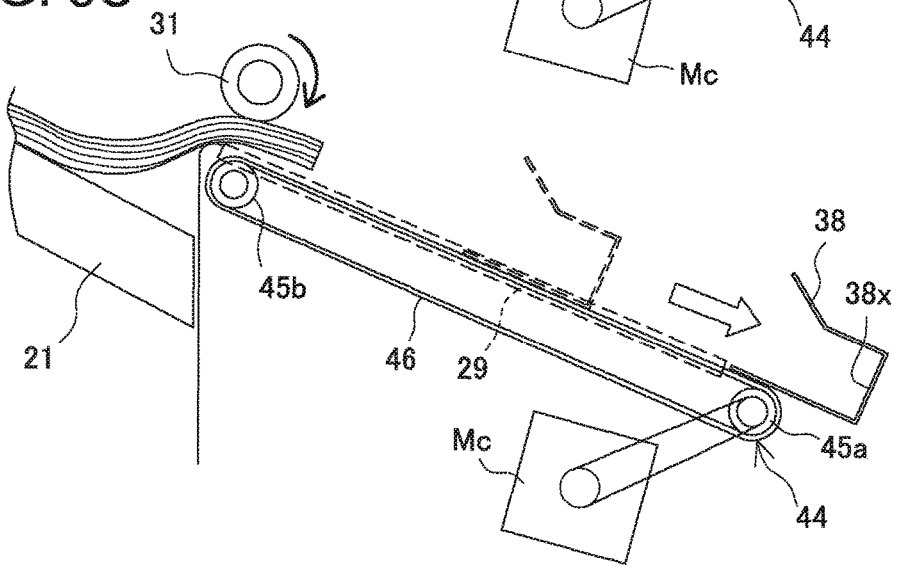

As shown in FIGS. 5A to 5C, the push-out lever 38 is comprised of a channel member substantially in the shape of a C in cross section, has a contact surface 38*x*, on the inner side, to come into contact with the rear end in the carrying-out direction of the sheet bunch on the processing tray 29, and is driven by a conveyor apparatus 44. The conveyor apparatus 44 has a conveyer belt 46 looped between a drive pulley 45*a* driven by a drive motor Mc and a driven pulley 45*b* to orbit-shift in both directions along the carrying-out direction of the sheet, and the push-out lever 38 is fixed to the conveyer belt 46. The push-out lever 38 is driven by the conveyer apparatus 44 as described above, and is thereby able to shift in both directions between an initial position near the rear end in the carrying-out direction of the processing tray 29 shown in FIG. 5A, and a maximum push-out position, shown by the solid line in FIG. 5B and phantom line in FIG. 5C, which is substantially intermediate between the drive pulley 45*a* and driven pulley 45*b*. In addition, in this Embodiment, the driven pulley 45*b* of the conveyer apparatus is provided to be able to rotate about the same axis as the driven roller 32 independently of the driven roller 32.

In the case of carrying out a sheet bunch subjected to the binding processing with the needleless binding apparatus 39 as the binding apparatus from the processing tray 29 to the first stack tray 21, as shown in FIG. 5A, in a state in which the contact surface 38*x* of the push-out lever 38 is brought into contact with the side on the rear end side in the carrying-out direction of the sheet bunch, the conveyer apparatus 44 is driven to shift the push-out lever 38 to the above-mentioned maximum push-out position in the carrying-out direction, and the sheet bunch is thereby pushed out to the position shown in FIG. 5B in the carrying-out direction on the processing tray 29. Further, in a state in which the forward/backward rotation roller 31 is brought into press-contact with the upper surface of the sheet bunch, the forward/backward rotation roller 31 is rotated clockwise in the figure with the drive motor to transport the sheet bunch in the carrying-out direction, and as shown in FIG. 5C, carries out the bunch on the processing tray 29 to the first stack tray 21. The push-out lever 38 brings the side on the rear end side in the carrying-out direction of the sheet into contact with the contact surface 38*x* and holds the entire bunch inside the push-out lever 38, and is thereby capable of being driven relatively at high speed. In contrast thereto, since the forward/backward rotation roller 31 directly contacts only the uppermost surface of the sheet bunch, it is preferable to rotate the roller 31 relatively at low speed to feed the sheet bunch toward the first stack tray 21 gradually. When carrying-out only by the forward/backward rotation roller 31 is started, the push-out lever 38 is returned to the initial position by shifting the conveyer belt 46 in the opposite direction. Thus, the forward/backward rotation roller 31 and push-out lever 38 function as a sheet bunch carrying-out mechanism for carrying out the sheet bunch subjected to the binding processing from the processing tray 29 toward the first stack tray 21.

Figure 8:
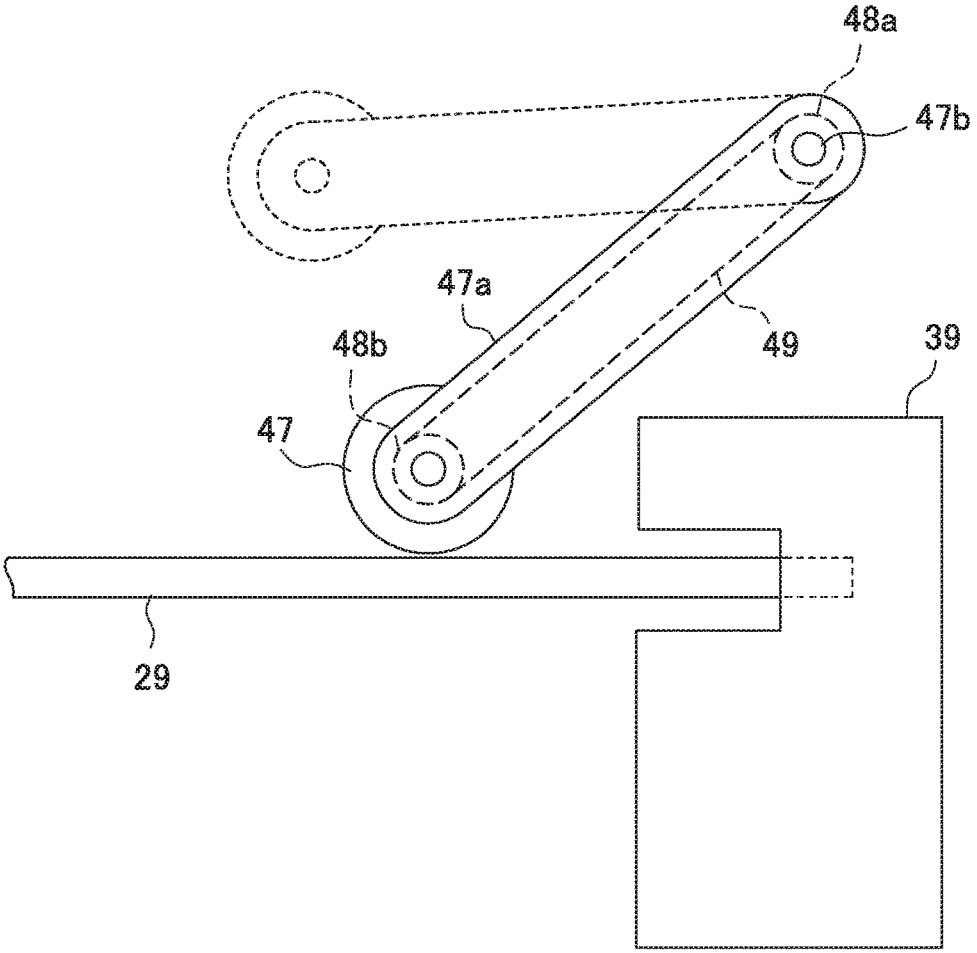
FIG. 8 is an explanatory view illustrating a configuration of a tilt roller of the peeling mechanism and its swing mechanism.

As shown in FIG. 8 in detail, the tilt roller 47 is supported rotatably by a front end portion of a bracket 47*a* of which a base end portion is axially supported to be swingably about a shaft 47*b* supported by the apparatus frame (not shown), the bracket 47*a* is swung a predetermined angle about the shaft 47*b* by forward/backward rotation of a swing motor (not shown), and in association therewith, the tilt roller 47 is moved up and down between the actuation position and the waiting position. Further, the base end portion of the bracket 47*a* is provided with a drive pulley 48*a* which is driven to rotate about the same axis as the shaft 47*b* by a rotation drive motor (not shown), the front end portion (on the tilt roller 47 side) of the bracket 47*a* is provided with a driven pulley 48*b* coupled to the tilt roller 47, and the tilt roller 47 is driven by the rotation drive motor via a transmission belt 49 looped between the drive pulley 48*a* and the driven roller 48*b*, and is configured to rotate in the direction for peeling the sheet bunch away from the binding apparatus in the actuation position. By this means, the tilt roller 47 functions as a peeling mechanism as described later.

The needleless binding apparatus 39 pressurizes and deforms the sheet bunch between a pair of press tooth members 39*b*, 39*c*, which are disposed to oppose each other and are capable of coming into press-contact and separating, to bind. One example will be described with reference to FIGS. 6A to 6C. The needleless binding apparatus 39 is provided with a base frame member 39*a*, a pair of press tooth members 39*b*, 39*c*, and a movable frame member 39*d* axially supported by the base frame member 39*a* swingably by a spindle 39*x*. To the base frame member 39*a* is attached a drive cam 39*e*, to the movable frame member 39*d* is attached a follower roller 39*f*, and the follower roller 39*f* engages in the drive cam 39*e*. The drive cam 39*e* is driven to rotate by a drive motor Md via a reduction mechanism, the follower roller 39*f* follows along the cam surface of the drive cam 39*e*, and the movable frame member 39*d* is thereby swung about the spindle 39*x* as the center. To the base frame member 39*a* and movable frame member 39*d* are attached the press tooth members 39*b*, 39*c* respectively to oppose each other. A biasing spring (not shown) is disposed between the base frame member 39*a* and the movable frame member 39*d*, and a pair of press tooth members 39*b*, 39 are biased in the directions for separating from each other.

Figure 6A:
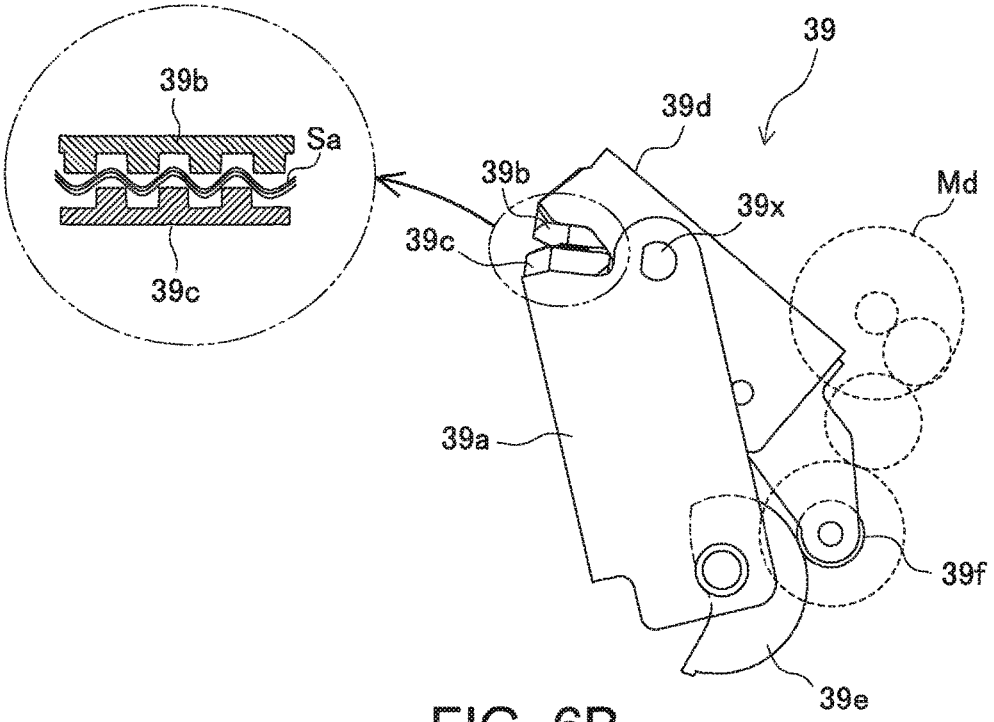
FIG. 6A is an explanatory view illustrating a configuration of a needleless binding apparatus.
Figure 6B:
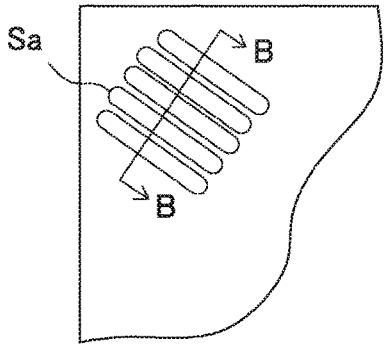
FIG. 6B is a partial enlarged view of a binding portion of a sheet bunch subjected to press binding processing.
Figure 6C:
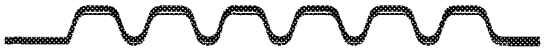
FIG. 6C is an enlarged cross-sectional view along line B-B of the partial enlarged view of FIG. 6B.

As shown with an enlarged view in FIG. 6A, on each of pressurizing surfaces of opposed press tooth members 39*b*, 39*c*, a plurality of press teeth extending in the ridge-line direction is formed side by side in a tooth-line direction perpendicular to the ridge-line direction, and the press tooth members 39*b*, 39*c* are disposed so that concavities and convexities formed by a plurality of press teeth formed on two pressurizing surfaces are meshed with one another. In this Embodiment, as shown in FIG. 6B, in order that a corrugated shape of binding portions Sa is formed obliquely with respect to one side of the sheet bunch, a pair of press tooth members 39*b*, 39*c* are disposed so that the tooth-line direction of a plurality of press teeth forms a predetermined angle with respect to the center reference Sx of the processing tray 29. By such a configuration, as shown in FIGS. 6B and 6C, the binding portions Sa of the sheet bunch pressurized by being nipped between a pair of press tooth members 39*b*, 39*c* are deformed in the corrugated shape in cross section, brought into intimate contact and bound. Further, by the biasing spring, operation for separating a pair of press tooth members 39*b*, 39*c* from the state of applying narrow pressure to the sheet bunch is performed more smoothly and promptly.

The base frame member 39*a* may be provided with a position sensor not shown to detect whether a pair of press tooth members 39*b*, 39*c* are in the press-contact position or the separate position. When the position sensor is provided, with a signal indicative of a relative position relationship between a pair of press members 39*b*, 39*c* from the position sensor, it is possible to perform the peeling processing described later subsequent to application of the binding processing more smoothly and efficiently.

In this Embodiment, as shown in FIG. 4, a binding processing position Ep to perform the press binding processing of a sheet bunch is set at the back of the processing tray 29 in the carry-in direction and on the apparatus back side i.e. in an adjacent region outside the left corner portion in FIG. 4 so as not to overlap the processing tray 29. The needleless binding apparatus 39 is disposed in the adjacent region outside the corner portion of the processing tray 29 corresponding to the binding processing position Ep. Accordingly, the sheet bunch carried in the processing tray 29 undergoes the press binding processing with the corner portion positioned at the back in the carry-in direction and on the apparatus back side as the binding portion.

[Control Section]

Figure 9:
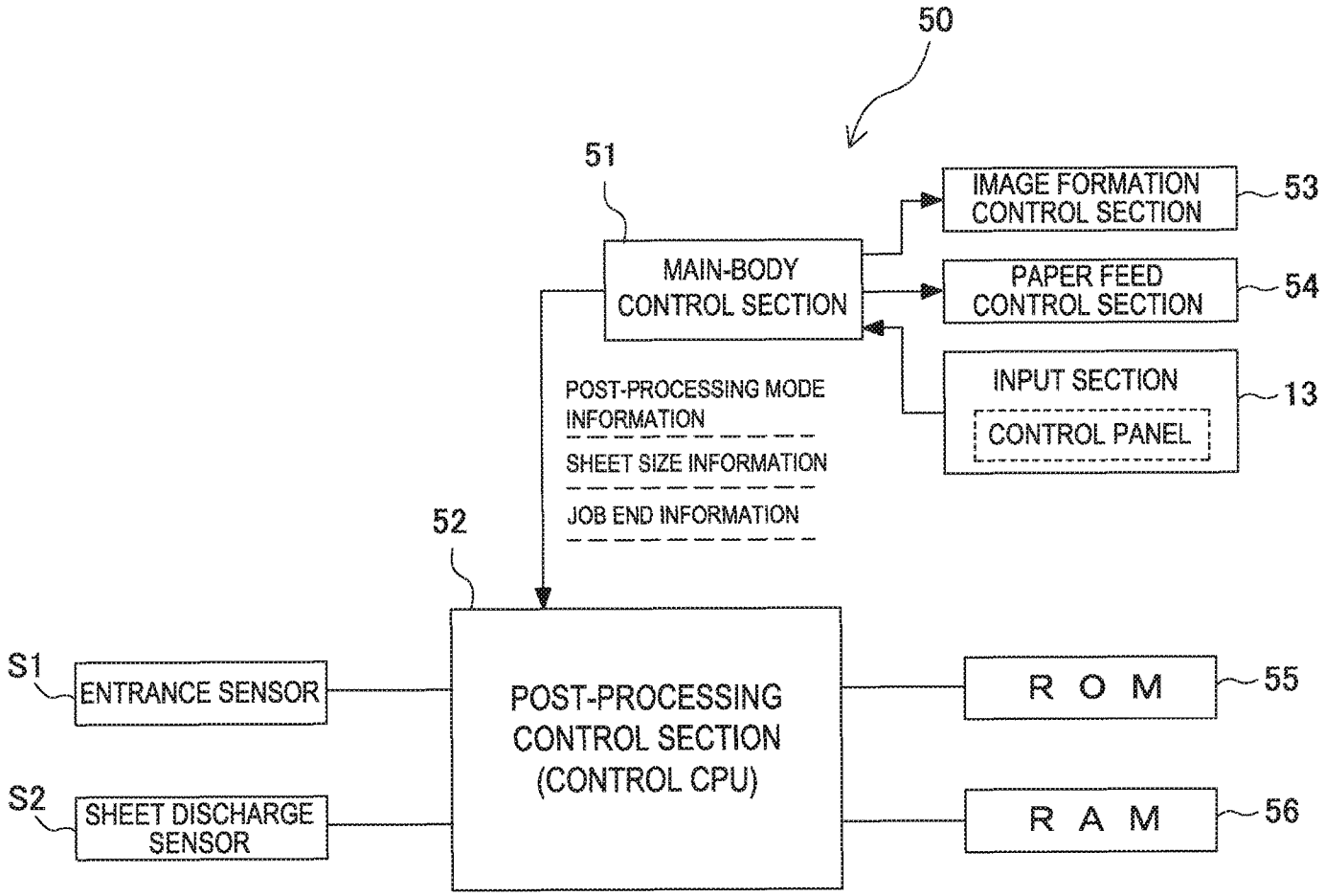
FIG. 9 is an explanatory diagram illustrating a configuration of a control apparatus of the image formation system shown in FIG. 1.
Figure 10:
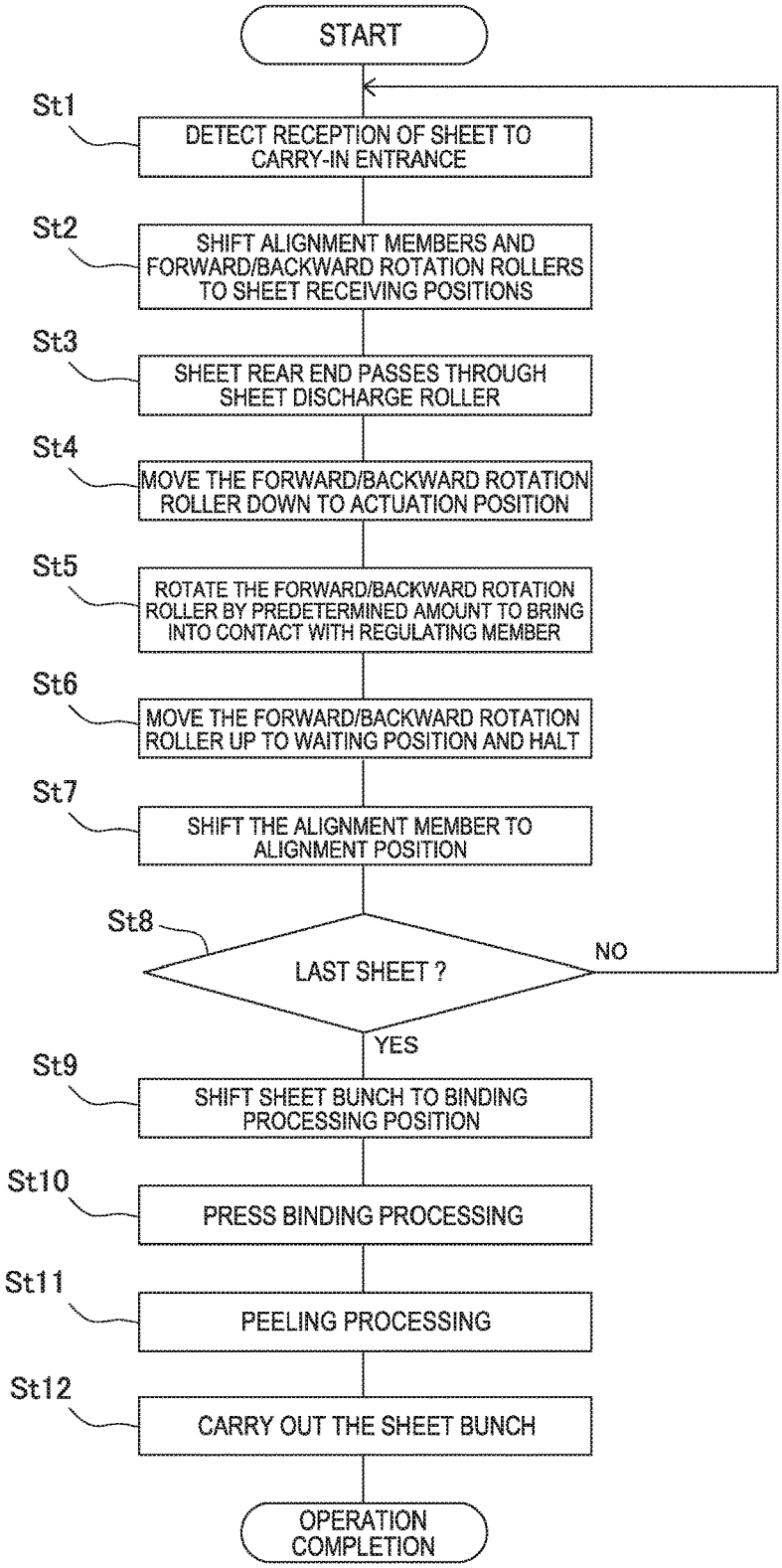
FIG. 10 is a flowchart illustrating a procedure of post-processing in the sheet bunch processing apparatus shown in FIG. 2.

A configuration of a control apparatus 50 of the above-mentioned image formation system will be described next with reference to FIG. 9. The control apparatus 50 of the image formation system is provided with a control section (hereinafter, described as "main-body control section") 51 that controls the image formation apparatus A, and a control section 52 (hereinafter, described as "post-processing control section") 52 that controls the sheet bunch processing apparatus B.

The main-body control section 51 is provided with an image formation control section 53, paper feed control section 54 and control panel 13 as an input section, and it is possible to set an "image formation mode" and "post-processing mode" from the control panel 13. In the image formation mode, it is possible to set the number of print-out copies, sheet size, sheet paper quality, color printing/monochrome printing, two-side printing/one-side printing, enlarged printing/reduced printing and other image formation conditions. Corresponding to the set image formation conditions, the main-body control section 51 controls the image formation control section 53 and paper feed control section 54, and after forming images on predetermined sheets, discharges the sheets from the main-body sheet discharge outlet 12 sequentially. Further, in the post-processing mode, for example, it is possible to set a "print-out mode", "needleless binding finish mode (eco-binding finish mode)", "sheet bunch folding finish mode" and the like. The main-body control section 51 transfers data of the finish mode and the number of sheets of post-processing, information on the number of copies, binding mode (one-portion binding or multiple binding of two or more portions) information, paper thickness information of the sheet to form the image and the like to the post-processing control section 52, and transfers a job end signal to the post-processing control section 52 whenever image formation is finished.

The post-processing control section 52 is comprised of a control CPU connected to ROM 55 and RAM 56, and corresponding to the designated post-processing mode, operates the sheet bunch processing apparatus B based on control programs stored in the ROM 55 and control data stored in the RAM 56. Therefore, the post-processing control section 52 is connected to a drive circuit of each motor, so as to perform control of start, halt and forward/backward rotation of each motor installed in the sheet bunch processing apparatus B. In each post-processing mode, the post-processing control section 52 performs control of the sheet bunch processing apparatus B to cause the apparatus to execute the following processing operation.

[Print-Out Mode]

In the print-out mode, for example, the image formation apparatus A forms images of a series of documents in order, for example, from the first page to nth page, and carries out sequentially from the main-body sheet discharge outlet 12. When the sheet bunch processing apparatus B detects that the front end of the sheet carried out of the image formation apparatus A arrives at the carry-in entrance 23 with the entrance sensor S1, the apparatus B rotation-drives the carry-in roller 25 and sheet discharge roller 26 to guide the sheet to the sheet discharge roller 26 along the sheet carry-in path P1. When the rear end of the sheet is detected with the sheet discharge sensor S2 provided near the sheet discharge outlet 24, after a lapse of predicted time the sheet front end arrives at the position of the forward/backward rotation roller 31 in the actuation position, the forward/backward rotation roller 31 moves down from the upper waiting position (state shown by dashed lines in FIG. 3) to the actuation position (state shown by the solid line in FIG. 3) for contacting the sheet on the processing tray 29, and is rotated clockwise in FIG. 3 with the forward/backward rotation motor. By this means, the sheet entering onto the processing tray 29 is carried out toward the first stack tray 21, and is stored on the first stack tray 21. Similarly, subsequent sheets are carried out sequentially toward the first stack tray 21 to be stacked and stored on the first stack tray 21.

Thus, in the print-out mode, the sheets with images formed in the image formation apparatus A are stored in the first stack tray 21 via the sheet carry-in path P1 of the sheet bunch processing apparatus B, and are loaded and stored upward sequentially. In the print-out mode, the sheets are not guided to the first switchback transport path SP1 and second switchback transport path SP2 as described previously.

[Sheet Bunch Folding Finish Mode]

In the sheet bunch folding finish mode, the sheet bunch processing apparatus B collates sheets carried out of the image formation apparatus A in the shape of a bunch, and then, finishes in the shape of a booklet. More specifically, when the sheet bunch processing apparatus B detects that the front end of the sheet carried out of the image formation apparatus A arrives at the carry-in entrance 23 with the entrance sensor S1, the apparatus B rotation-drives the carry-in roller 25 and sheet discharge roller 26 to guide to the sheet discharge roller 26 along the sheet carry-in path P1. Next, using a signal that is issued from the entrance sensor S1 at the time of detecting the sheet rear end as a reference, at timing at which the sheet rear end passes through the path switch piece 27, the post-processing control section 52 halts rotation of the sheet discharge roller 26, concurrently turns the path switch piece 27 upward from the state shown in FIG. 3, and rotates the sheet discharge roller 26 backward counterclockwise in FIG. 3. By this means, the sheet entering to the sheet carry-in path P1 is reversed in the transport direction, is led to the second switchback transport path SP2 by the path switch piece 27, and is guided to the collection guide 34.

Similarly, subsequent sheets are collated on the collection guide 34 via the second switchback transport path SP2. Upon receiving a job end signal, the post-processing control section 52 controls to operate the saddle stitch stapler 36 to perform the staple binding processing in two portions at the center of the sheet bunch, then position the sheet center in a folding position, perform folding processing with a pair of folding rollers 35, and carry out the sheet bunch folded in the shape of a booklet to the second stack tray 22.

[Needleless Binding Finish Mode]

In the sheet bunch processing apparatus B according to the present invention, in the needleless binding finish mode, it is a characteristic respect to perform peeling processing of the sheet bunch away from the press tooth members 39*b*, 39*c* of the needleless binding apparatus 39 subsequently to the press binding processing before sheet bunch carrying-out processing for carrying out the sheet bunch from the processing tray 29. Hereinafter, with reference to FIGS. 10 to 15, detailed description will be given to control of operation of the sheet bunch processing apparatus B performed by the post-processing control section 52 in the needleless binding finish mode, particularly, the peeling processing and sheet bunch carrying-out processing in the mode.

In the needleless binding finish mode, as in the case of the print-out mode, the image formation apparatus A forms images of a series of documents in order from the first page to nth page, and carries out sequentially from the main-body sheet discharge outlet 12, and when the sheet bunch processing apparatus B detects that the front end of the sheet carried out of the image formation apparatus A arrives at the carry-in entrance 23 with the entrance sensor S1, the apparatus B rotation-drives the carry-in roller 25 and sheet discharge roller 26 to guide to the sheet discharge roller 26 along the sheet carry-in path P1 (step St1). Further, when it is detected that the front end of the sheet arrives at the carry-in entrance 23, the apparatus shifts the alignment members 40*a*, 40*b* to sheet receiving positions spaced a sufficient distance apart from the center reference Sx so as not to interfere with carry-in of the sheet to the processing tray 29, and shifts the forward/backward rotation roller 31 to the waiting position (i.e. sheet receiving position) (step St2).

Figure 11A:
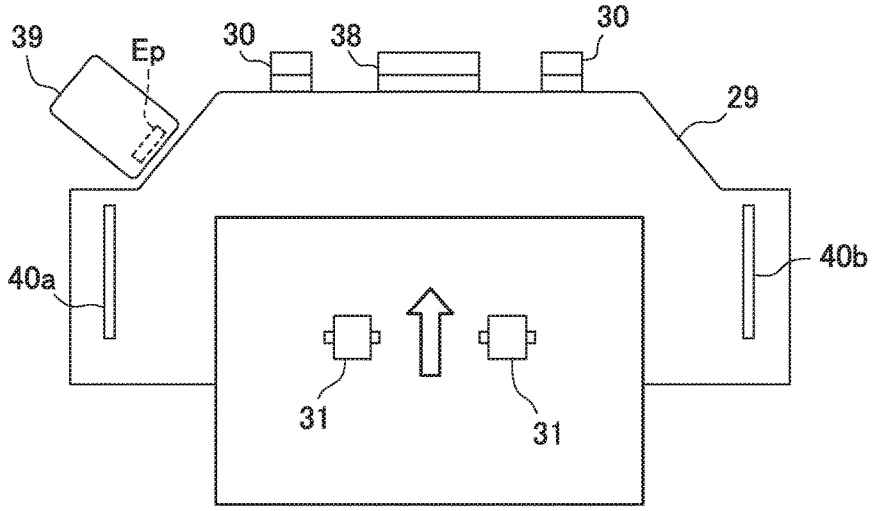
FIGS. 11A to 11E contain schematic explanatory views in viewing, from above a processing tray, steps of performing binding processing on a sheet bunch obtained by collecting sheets carried onto the processing tray, where

Next, when it is detected that the rear end of the sheet passes through the sheet discharge roller 26 with the sheet discharge sensor S2 provided near the sheet discharge outlet 24 (step St3), after a lapse of predicted time the sheet front end arrives at the position of the forward/backward rotation roller 31 in the actuation position, as shown in FIG. 11A, the post-processing control section 52 moves the forward/backward rotation roller 31 down from the upper waiting position to the actuation position for contacting the sheet on the processing tray 29 (step St4), rotates the forward/backward rotation roller 31 a predetermined amount counterclockwise in FIG. 3, and feeds the sheet toward the regulating member 30 on the processing tray 29 (step St5). At this point, the take-in rotating body 33 is also rotated counterclockwise in FIG. 3, and as shown in FIG. 11B, the sheet is transported until the side on the front end side of the sheet in the travel direction comes into contact with the regulating member 30.

Figure 11B:
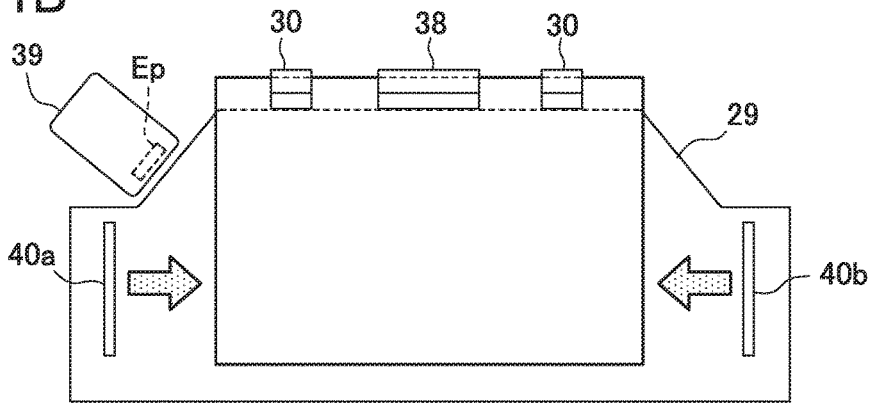
Figure 11C:
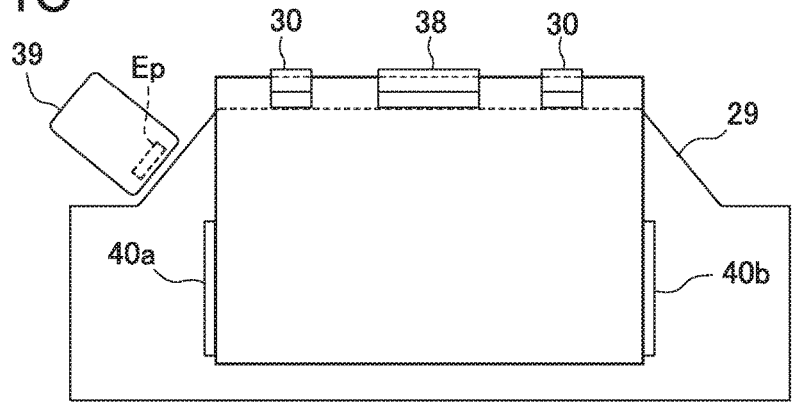

When carry-in of the sheet to the processing tray 29 is halted by contact of the sheet with the regulating member 30, the post-processing control section 52 moves the forward/backward rotation roller 31 up to the waiting position to halt (step St6), and as shown in FIG. 11B, shifts the alignment members 40*a*, 40*b* inward from the receiving positions so as to nip the sheet from opposite sides in the width direction (step St7). The alignment members 40*a*, 40*b* bring respective regulating surfaces 40*x* into contact with sides (i.e. two sides facing the width direction) on opposite sides in the width direction of the sheet, and are shifted to positions (alignment positions) where a separate distance between both of the regulating surfaces 40*x* coincides with the width dimension of the sheet. By this means, as shown in FIG. 11C, each sheet is aligned so that its center in the width direction coincides with the center reference Sx of the processing tray 29. Until a predetermined number of sheets bound as a single sheet bunch are aligned and collected on the processing tray 29 as described above, the above-mentioned steps St1 to St7 are repeated (step St8).

Figure 11D:
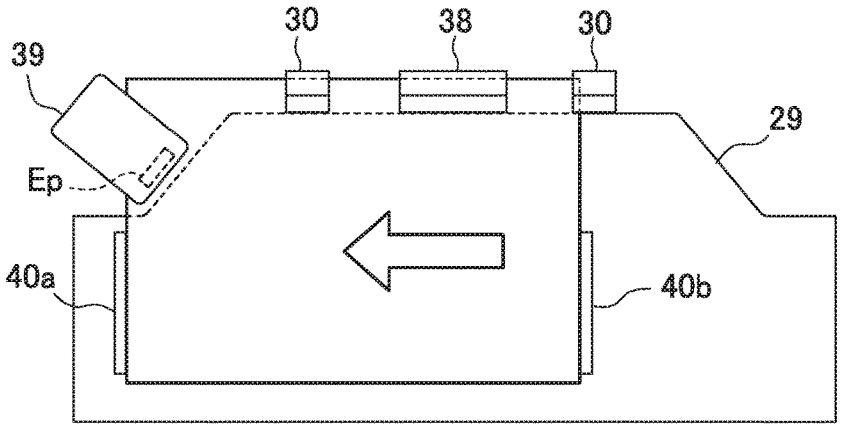
Figure 11E:
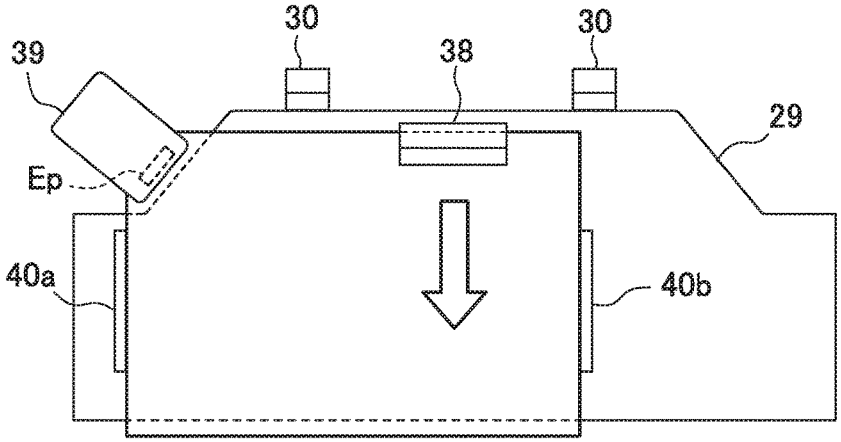

When a predetermined number of sheets are aligned and collected on the processing tray 29, the post-processing control section 52 drives the alignment members 40*a*, 40*b* and push-out lever 38, and shifts the sheet bunch obtained by collecting the sheets to the binding processing position (step St9). In the Embodiment shown in the figure, first, as shown in FIG. 11D, the post-processing control section 52 does not return the alignment members 40*a*, 40*b* to the receiving positions, and off set-shifts by a predetermined off set amount toward the binding processing position Ep side in the width direction, while nipping the sheet bunch from the opposite sides in the width direction. At this point, the alignment members 40*a*, 40*b* are halted in positions in which the side on the apparatus back side of the sheet bunch passes over the binding processing position Ep slightly in the width direction. In the state shown in FIG. 11D, the side on the apparatus back side of the sheet bunch is disposed between separated press tooth members 39*b*, 39*c* of the needleless binding apparatus 39, while being sufficiently spaced apart from the press tooth members 39*b*, 39*c*. In this state, the post-processing control section 52 drives the conveyer apparatus 44 to shift the push-out lever 38 in the carrying-out direction (direction for carrying out from the processing tray 29), and pushes the sheet bunch in the carrying-out direction to shift by a predetermined distance in the carrying-out direction. The push-out lever 38 halts the side of the sheet bunch in a position slightly before the binding processing position Ep in the carrying-out direction. By this means, as shown in FIG. 11E, the corner portion of the sheet bunch to perform the binding processing is positioned in the binding processing position Ep.

When the corner portion of the sheet bunch is positioned in the binding processing position Ep, the post-processing control section 52 issues a command signal, and drives the needleless binding apparatus 39 to cause the apparatus to execute the press binding processing (step St10). By this means, the needleless binding apparatus 39 pressurizes and deforms the corner portion of the sheet bunch between a pair of meshed press tooth members 39*b*, 39*c* in the corrugated shape in cross section shown in FIG. 6C to bind. After the press binding processing, the needleless binding apparatus 39 separates a pair of press tooth members 39*b*, 39*c*, and issues a processing end signal to the post-processing control section 52.

When the press binding processing is finished, the post-processing control section 52 drives the peeling mechanism comprised of the push-out lever 38 and side alignment mechanism 37 as the push-out members, performs the peeling processing for peeling the corner portion of the sheet bunch in intimate contact with one of separated press tooth members 39*b*, 39*c* away from the press tooth member 39*b* or 39*c* (step St11), then drives the sheet bunch carrying-out mechanism comprised of the push-out lever 38 and the forward/backward rotation roller 31, and performs the sheet bunch carrying-out processing for carrying out the sheet bunch subjected to the press binding processing from the processing tray 29 to the first stack tray 21 (step St12). The peeling processing and sheet bunch carrying-out processing will be described below in detail.

[Peeling Processing and Sheet Bunch Carrying-Out Processing]

In the press binding processing, since the sheet bunch is pressed strongly against a pair of press tooth members 39*b*, 39*c* having press teeth, the sheet bunch bites into one of a pair of press tooth members 39*b*, 39*c* to be in an intimate contact state, and when the sheet bunch is carried out forcibly in this state, there is the risk that binding is weak, and that failure occurs in the transport mechanism and sheet. Therefore, in the sheet bunch processing apparatus B according to the present invention, after performing the peeling processing using the peeling mechanism subsequent to the press binding processing, the sheet bunch is carried out from the processing tray 29. The peeling mechanism applies a force to the sheet bunch in the direction for decreasing resistance of the sheet bunch bitten into the press teeth of the press tooth members 39*b*, 39*c* to the press teeth, and thereby peels the sheet bunch away from the press teeth by a small force. In this Embodiment, in order to minimize resistance of the sheet bunch to the press teeth, the peeling mechanism applies a force to the sheet bunch in the ridge-line direction of the press teeth of the press tooth members 39*b*, 39*c*.

Figure 12:
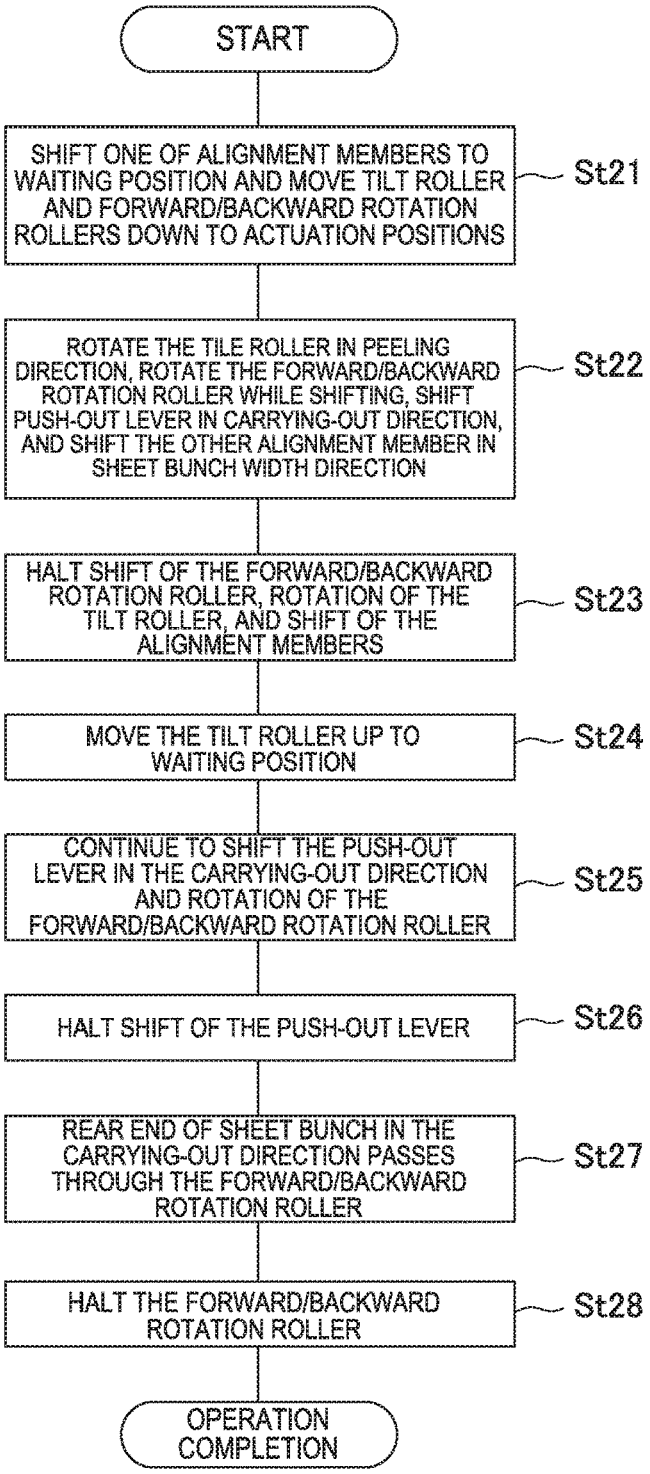
FIG. 12 is a flowchart more specifically illustrating a procedure of peeling of the sheet bunch away from press tooth members and carrying-out of the sheet bunch from the processing tray, in the case of using a combination of the tilt roller, forward-backward rotation rollers as a shift roller, push-out lever, and alignment members as the peeling mechanism.

Referring to FIGS. 12 and 13, control procedures in the peeling processing and sheet bunch carrying-out processing will be described below in detail in the case of using, as the peeling mechanism, a combination of the tilt roller 47, the forward/backward rotation roller 31 as the shift roller, and the push-out lever 38 and alignment member 40*a* as two push-out members capable of applying forces in two linear independent directions (i.e. non-parallel directions) to a sheet bunch.

Figure 13A:
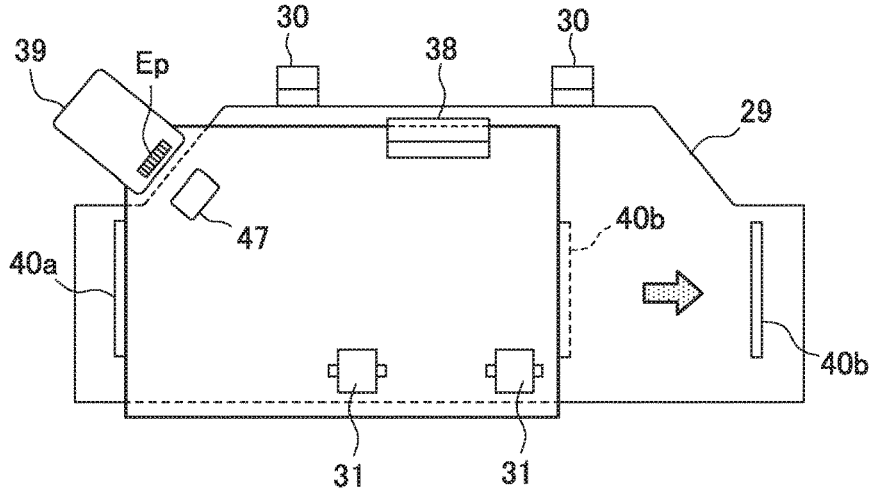
FIGS. 13A to 13C contain schematic explanatory views in viewing, from above the processing tray, steps of operation for peeling the sheet bunch away from press tooth members, and operation for carrying out the sheet bunch from the processing tray to the stack tray, where

When the press binding processing is finished, as shown in FIG. 13A, the post-processing control section 52 drives the drive motor Mb, shifts the alignment member 40*b* on the farther side (right side in FIGS. 13A to 13C) from the needleless binding apparatus 39 toward the waiting position in the direction for separating from the side facing the width direction of the sheet bunch, drives the swing motor (not shown), and moves the tilt roller 47 and the forward/backward rotation roller 31 as the shift roller down from the upper waiting positions to the actuation positions for coming into contact with the sheet bunch (step St21).

Next, in a state in which the tilt roller 47 and forward/backward rotation rollers 31 are brought into contact with the sheet bunch, the post-processing control section 52 drives the rotation drive motor not shown to rotate the tilt roller 47 in the direction (clockwise in FIG. 8) for separating the sheet bunch from the needleless binding apparatus 39, drives the forward/backward rotation motor and shift drive motor not shown, and rotates the forward/backward rotation roller 31 in the direction for carrying out the sheet bunch, while shifting in the direction for separating from the needleless binding apparatus 39 in the width direction of the sheet bunch (step St22). At this point, the shift and rotation of the forward/backward rotation roller 31 is controlled so that a force action axis line extending in an action direction of a resultant force of a force applied to the sheet bunch by the shift of the forward/backward rotation roller 31 and a force applied to the sheet bunch by the rotation of the forward/backward rotation roller 31 extends in a direction substantially parallel with the ridge-line direction of the press teeth of the press tooth members 39*b*, 39*c*. At the same time, in a state in which the push-out lever 38 and alignment member 40*a* are brought into contact with adjacent different sides of the sheet bunch, the section drives the conveyer apparatus 44 to shift the push-out lever 38 in the carrying-out direction, and drives the drive motor Ma to shift the alignment member 40*a* in the width direction (direction perpendicular to the carrying-out direction) toward the other alignment member 40*b*. At this point, the shifts of the push-out lever 38 and alignment member 40*a* are controlled so that a force action axis line extending in an action direction of a resultant force of a force applied to the sheet bunch by the shift of the push-out lever 38 and a force applied to the sheet bunch by the shift of the alignment member 40*a* extends in the direction substantially parallel with the ridge-line direction of the press teeth of the press tooth members 39*b*, 39*c*.

Figure 13B:
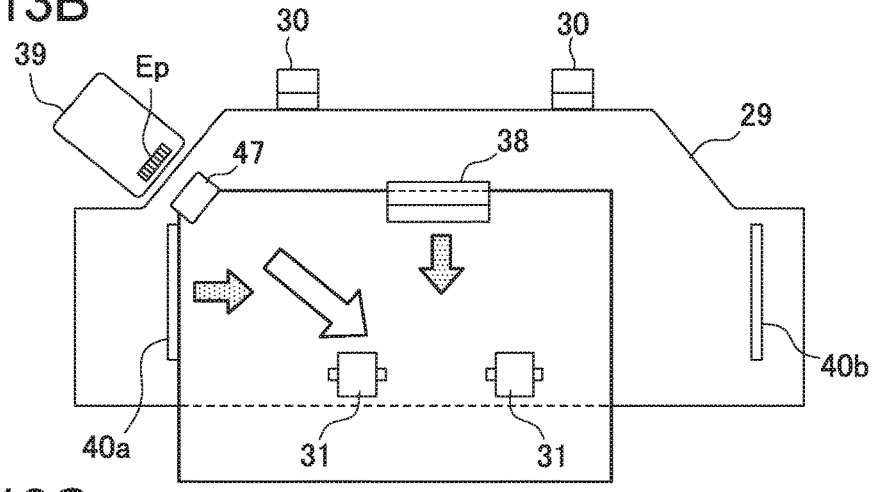

By this means, both the resultant force of a force applied to the sheet bunch by the rotation of the tilt roller 47 and forces applied to the sheet bunch by the shift and rotation of the forward/backward rotation roller 31, and the resultant force of forces applied to the sheet bunch by the push-out lever 38 and the alignment member 40*a* act on the sheet bunch in the ridge-line direction of the press teeth of the press tooth members 39*b*, 39*c* i.e. the direction for minimizing resistance of the sheet bunch bitten into the press teeth of the press tooth members 39*b*, 39*c* to the press teeth, and as shown in FIG. 13B, the sheet bunch is shifted in the ridge-line direction of the press teeth with respect to the needleless binding apparatus 39. As a result, it is possible to perform the peeling of the sheet bunch away from the press tooth members 39*b*, 39*c* by a small force. Thus, the combination of the tilt roller 47, the forward/backward rotation roller 31 as the shift roller, the push-out lever 38 and the alignment member 40*a* functions as the peeling mechanism.

Figure 13C:
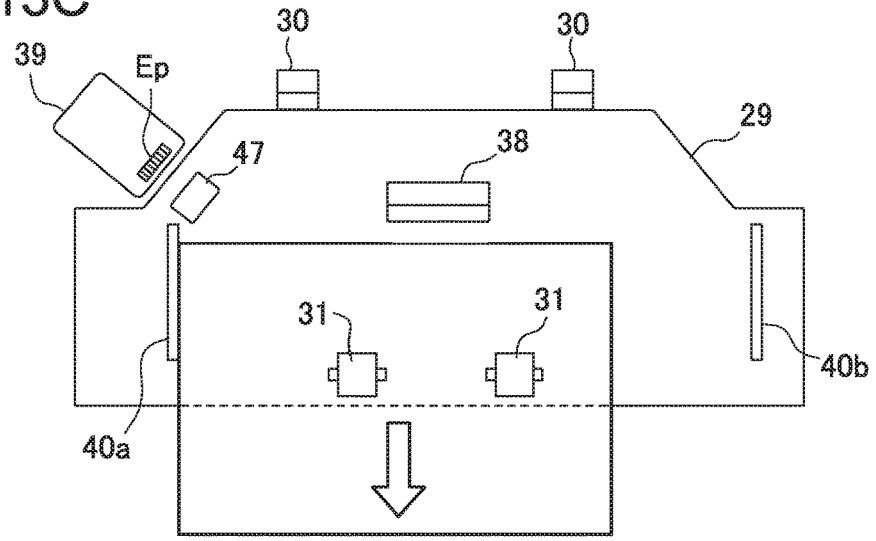

When the peeling processing is completed, the post-processing control section 52 halts the rotation of the tilt roller 47, the shift of the forward/backward rotation roller 31 and the shift of the alignment member 40*a* (step St23), and in order not to interfere with the sheet bunch carrying-out processing, drives the swing motor (not shown) to move the tilt roller 47 up from the actuation position for coming into contact with the sheet bunch to the upper waiting position (step St24). In addition, the section continues the rotation of the forward/backward rotation roller 31 and the shift of the push-out lever 38 in the carrying-out direction (step St25). After the above-mentioned step St23, the push-out lever 38 is halted, when the sheet bunch is shifted by a predetermined distance in the carrying-out direction. Subsequently, as shown in FIG. 13C, only the forward/backward rotation roller 31 carries out the sheet bunch from the processing tray 29 toward the first stack tray 21, and by rotating the drive motor Mc in the direction opposite to that in the shift in the carrying-out direction, the push-out lever 38 is returned to the initial position as shown in FIG. 11A (step St26). At this point, in order for the uppermost sheet of the sheet bunch not to slide over the lower sheet, it is preferable that the forward/backward rotation roller 31 is rotated relatively at low speed to feed the sheet bunch gradually toward the first stack tray 21. In addition, it is possible to perform the carrying-out processing of the sheet bunch only by the forward/backward rotation roller 31, and in step S23, in halting the tilt roller 47, the shift of forward/backward rotation roller 31 and the shift of the alignment member 40*a*, the shift of the push-out lever 38 in the carrying-out direction may be halted.

Thus, the sheet bunch is shifted by the forward/backward rotation roller 31 and push-out lever 38. In other words, herein, the forward/backward rotation roller 31 and push-out lever 38 function as the sheet bunch carrying-out mechanism.

When the sheet bunch is carried out from the processing tray 29 in the carrying-out direction, and the rear end (upper end portion in FIG. 13C) of the sheet bunch in the carrying-out direction passes through the forward/backward rotation roller 31 (step St27), the post-processing control section 52 halts the rotation of the forward/backward rotation roller 31, and completes the sheet bunch carrying-out processing (step St28).

FIGS. 12 and 13 illustrate the control procedures in the case of using, as the peeling mechanism, the tilt roller 47, the forward/backward rotation roller 31 as the shift roller, and the push-out lever 38 and alignment member 40*a* as two push-out members capable of applying forces in two linear independent directions (i.e. non-parallel directions) to a sheet bunch. In addition, as the peeling mechanism, it is also possible to use one or a combination of two in the combination of the tilt roller 47, the forward/backward rotation roller 31, the push-out lever 38 and the alignment member 40*a*. For example, it is also possible to perform the peeling processing by a combination of the tilt roller 47, the push-out lever 38 and the alignment member 40*a* without using the forward/backward rotation roller 31 as the peeling mechanism, and it is also possible to perform the peeling processing by a combination of the forward/backward rotation roller 31 as the shift roller, the push-out lever 38 and the alignment member 40*a* without providing the tilt roller 47.

Figure 14:
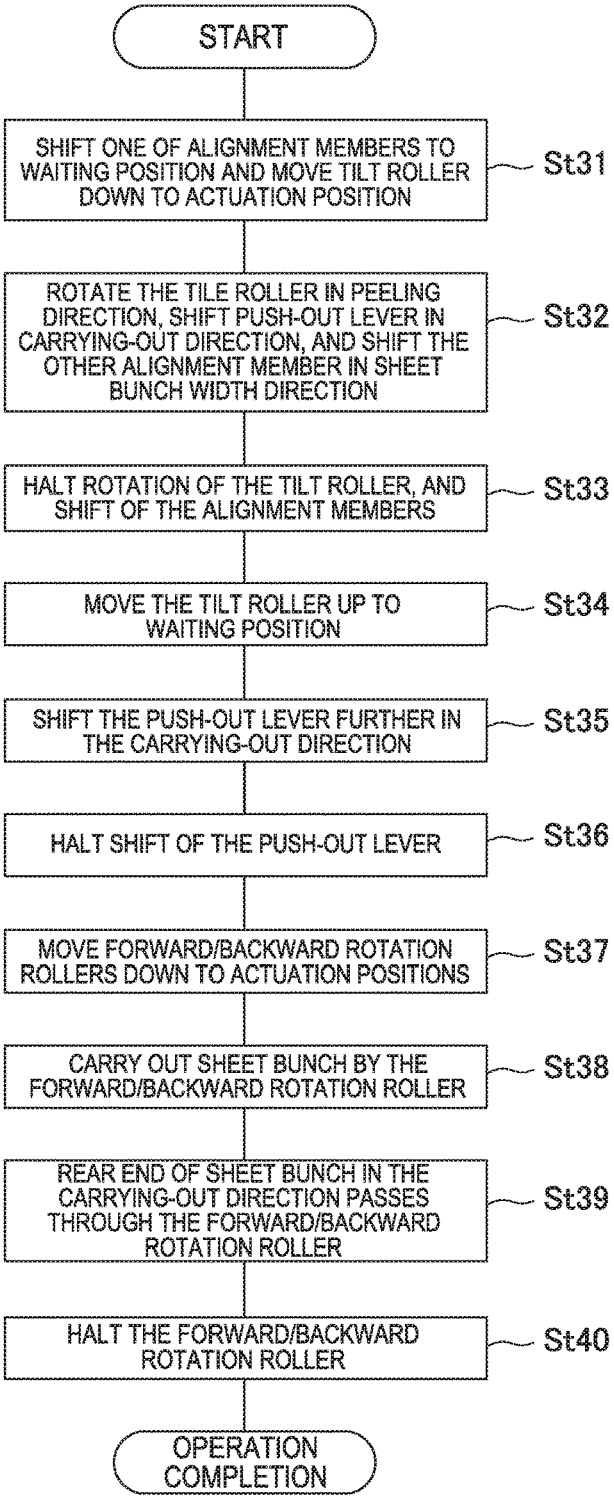
FIG. 14 is a flowchart more specifically illustrating a procedure of peeling of the sheet bunch away from press tooth members and carrying-out of the sheet bunch from the processing tray, in the case of using a combination of the tilt roller, push-out lever, and alignment members as the peeling mechanism.

In the case of performing the peeling processing by the combination of the tilt roller 47, the push-out lever 38 and the alignment member 40*a* without using the forward/backward rotation roller 31 as the peeling mechanism, the post-processing control section 52 performs control as described below (see FIG. 14).

When the press binding processing is finished, the post-processing control section 52 drives the drive motor Mb, shifts the alignment member 40*b* toward the waiting position in the direction for separating from the side facing the width direction of the sheet bunch, and drives the swing motor (not shown) to move the tilt roller 47 down from the upper waiting position to the actuation position for coming into contact with the sheet bunch (step St31). At this point, as distinct from step St21, the forward/backward rotation roller 31 is not moved down to the actuation position. Next, in a state in which the tilt roller 47 is brought into contact with the sheet bunch, the post-processing control section 52 drives the rotation drive motor not shown to rotate the tilt roller 47 in the direction for separating the sheet bunch from the needleless binding apparatus 39 (step st32). At the same time, in the state in which the push-out lever 38 and alignment member 40*a* are brought into contact with adjacent different sides of the sheet bunch, the section drives the conveyer apparatus 44 to shift the push-out lever 38 in the carrying-out direction, and drives the drive motor Ma to shift the alignment member 40*a* in the width direction (direction perpendicular to the carrying-out direction) toward the other alignment member 40*b*. At this point, the shifts of the push-out lever 38 and alignment member 40*a* are controlled so that the force action axis line extending in the action direction of the resultant force of the force applied to the sheet bunch by the shift of the push-out lever 38 and the force applied to the sheet bunch by the shift of the alignment member 40*a* extends in the direction substantially parallel with the ridge-line direction of the press teeth of the press tooth members 39*b*, 39*c*.

Also in this case, as in the case shown in FIGS. 12 and 13, both the force applied to the sheet bunch by the rotation of the tilt roller 47 and the resultant force of forces applied to the sheet bunch by the push-out lever 38 and the alignment member 40*a* act on the sheet bunch in the ridge-line direction of the press teeth of the press tooth members 39*b*, 39*c*, the sheet bunch is shifted in the ridge-line direction of the press teeth with respect to the needleless binding apparatus 39, and it is possible to perform the peeling of the sheet bunch away from the press tooth members 39*b*, 39*c* by a small force.

When the peeling processing is completed, the post-processing control section 52 halts the rotation of the tilt roller 47 and the shift of the alignment member 40*a* (step St33), and in order not to interfere with the sheet bunch carrying-out processing, drives the swing motor to move the tilt roller 47 up from the actuation position the waiting position (step St34). In addition, the section continues the shift of the push-out lever 38 in the carrying-out direction (step St35). When the sheet bunch is shifted by a predetermined distance in the carrying-out direction, the push-out lever 38 is halted, and by rotating the drive motor Mc in the direction opposite to that in the shift in the carrying-out direction, is returned to the initial position (step St36). Next, the post-processing control section 52 drives the swing motor not shown to move the forward/backward rotation roller 31 down from the waiting position to the actuation position (step St37), and in a state in which the forward/backward rotation roller 31 is brought into contact with the sheet bunch, drives the rotation drive motor not shown to carry out the sheet bunch from the processing tray 29 toward the first stack tray 21 (step St38). When the rear end of the sheet bunch in the carrying-out direction passes through the forward/backward rotation roller 31 (step St39), the post-processing control section 52 halts the rotation of the forward/backward rotation roller 31, and completes the sheet bunch carrying-out processing (step St40).

In the above-mentioned case, it is indisputable that it is possible to perform the peeling processing similarly by using only the tilt roller 47 without using the push-out lever 38 and the alignment member 40*a* as the peeling mechanism.

Figure 15:
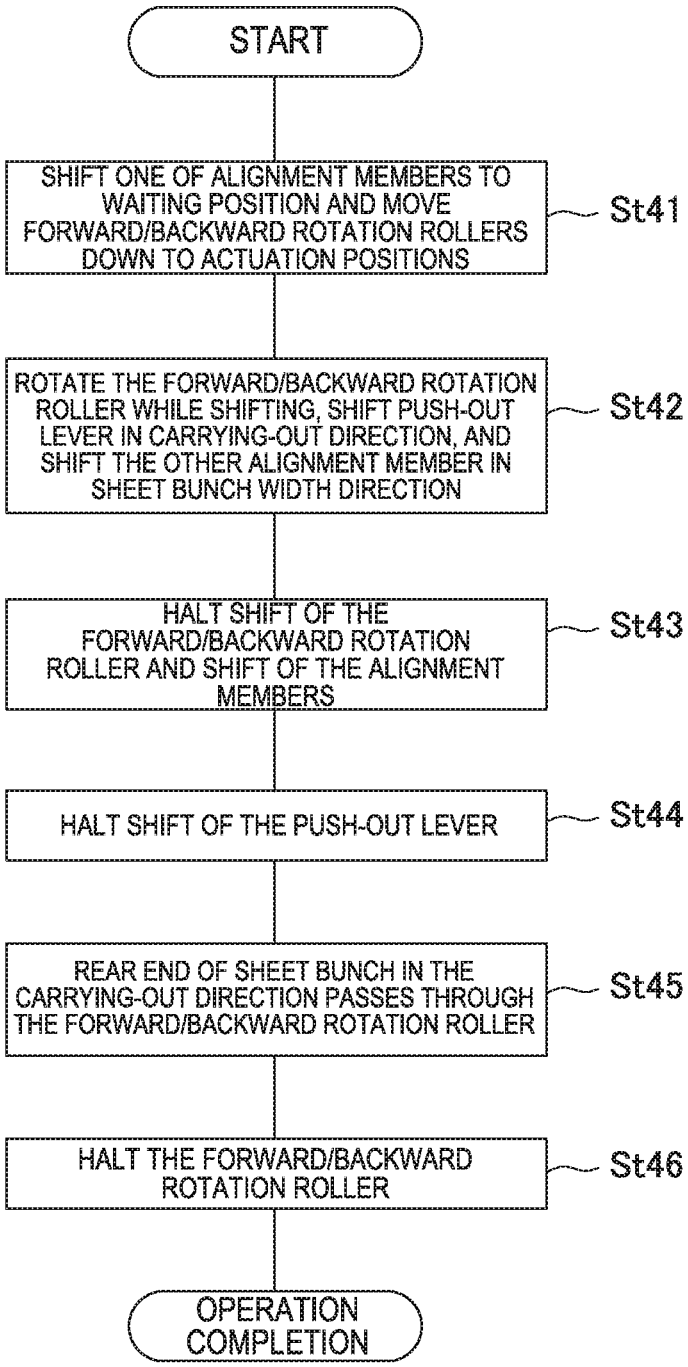
FIG. 15 is a flowchart more specifically illustrating a procedure of peeling of the sheet bunch away from press tooth members and carrying-out of the sheet bunch from the processing tray, in the case of using a combination of forward-backward rotation rollers as the shift roller, push-out lever, and alignment members as the peeling mechanism.

Further, in the case of performing the peeling processing by the combination of the forward/backward rotation roller 31, the push-out lever 38 and the alignment member 40*a* without providing or using the tilt roller 47 as the peeling mechanism, the post-processing control section 52 performs control as described below (see FIG. 15).

When the press binding processing is finished, the post-processing control section 52 drives the drive motor Mb, shifts the alignment member 40*b* toward the waiting position in the direction for separating from the side facing the width direction of the sheet bunch, drives the swing motor (not shown), and moves the forward/backward rotation roller 31 as the shift roller down from the upper waiting position to the actuation position for coming into contact with the sheet bunch (step St41). Next, in the state in which the forward/backward rotation roller 31 is brought into contact with the sheet bunch, the post-processing control section 52 drives the forward/backward rotation motor and shift drive motor not shown, and rotates the forward/backward rotation roller 31 in the direction for carrying out the sheet bunch, while shifting in the direction for separating from the needleless binding apparatus 39 in the width direction of the sheet bunch along the rotation axis line of the swing rotation shaft 32*b* (i.e. in the rotation axis line direction of the forward/backward rotation roller 31) (step St42). At this point, the shift and rotation of the forward/backward rotation roller 31 is controlled so that the force action axis line extending in the action direction of the resultant force of the force applied to the sheet bunch by the shift of the forward/backward rotation roller 31 and the force applied to the sheet bunch by the rotation of the forward/backward rotation roller 31 extends in the direction substantially parallel with the ridge-line direction of the press teeth of the press tooth members 39*b*, 39*c*. At the same time, in the state in which the push-out lever 38 and alignment member 40*a* are brought into contact with adjacent different sides of the sheet bunch, the section drives the conveyer apparatus 44 to shift the push-out lever 38 in the carrying-out direction, and drives the drive motor Ma to shift the alignment member 40*a* in the width direction (direction perpendicular to the carrying-out direction) toward the other alignment member 40*b*. At this point, the shifts of the push-out lever 38 and alignment member 40*a* are controlled so that the force action axis line extending in the action direction of the resultant force of the force applied to the sheet bunch by the shift of the push-out lever 38 and the force applied to the sheet bunch by the shift of the alignment member 40*a* extends in the direction substantially parallel with the ridge-line direction of the press teeth of the press tooth members 39*b*, 39*c*.

Also in this, as in the case shown in FIGS. 12 and 13, both the resultant force of forces applied to the sheet bunch by the shift and rotation of the forward/backward rotation roller 31, and the resultant force of forces applied to the sheet bunch by the push-out lever 38 and the alignment member 40*a* act on the sheet bunch in the ridge-line direction of the press teeth of the press tooth members 39*b*, 39*c*, the sheet bunch is shifted in the ridge-line direction of the press teeth with respect to the needleless binding apparatus 39, and it is possible to perform the peeling of the sheet bunch away from the press tooth members 39*b*, 39*c* by a small force.

When the peeling processing is completed, the post-processing control section 52 halts the shift of the forward/backward rotation roller 31 and the shift of the alignment member 40*a* (step St43), while continuing the rotation of the forward/backward rotation roller 31 and the shift of the push-out lever 38 in the carrying-out direction 38, and after shifting the sheet bunch by a predetermined distance in the carrying-out direction, halts the push-out lever 38 (step St44) to carry out the sheet bunch from the processing tray 29 toward the first stack tray 21 by only the forward/backward rotation roller 31. In addition, after the halt, by rotating the drive motor Mc in the direction opposite to that in the shift in the carrying-out direction, the push-out lever 38 is returned to the initial position as shown in FIG. 11A. Further, it is also possible to perform the carrying-out processing of the sheet bunch only by the forward/backward rotation roller 31, and in step S43, in halting the shift of the forward/backward rotation roller 31 and the shift of the alignment member 40*a*, the shift of the push-out lever 38 in the carrying-out direction may be halted. Next, when the rear end of the sheet bunch in the carrying-out direction passes through the forward/backward rotation roller 31 (step St45), the post-processing control section 52 halts the rotation of the forward/backward rotation roller 31, and completes the sheet bunch carrying-out processing (step St46).

In the above-mentioned case, it is indisputable that it is possible to perform the peeling processing similarly by using only the forward/backward rotation roller 31 without using the push-out lever 38 and the alignment member 40*a* as the peeling mechanism.

Hereinafter, for control procedures in the peeling processing and sheet bunch carrying-out processing in the case of using, as the peeling mechanism, a combination of the push-out lever 38 and alignment member 40*a* as two push-out members capable of applying forces in two linear independent directions (i.e. non-parallel directions) to a sheet bunch, with reference to FIGS. 16 and 17, detailed description will be given to control of operation of the sheet bunch processing apparatus B performed by the post-processing control section 52 in the needleless binding finish mode, particularly, the peeling processing in the mode.

[Needleless Binding Finish Mode]

In the needleless binding finish mode, as in the case of the print-out mode, the image formation apparatus A forms images of a series of documents in order from the first page to nth page, and carries out sequentially from the main-body sheet discharge outlet 12, and when the sheet bunch processing apparatus B detects that the front end of the sheet carried out of the image formation apparatus A arrives at the carry-in entrance 23 with the entrance sensor S1, the apparatus B rotation-drives the carry-in roller 25 and sheet discharge roller 26 to guide to the sheet discharge roller 26 along the sheet carry-in path P1 (step St1). Further, when it is detected that the front end of the sheet arrives at the carry-in entrance 23, the apparatus shifts the alignment members 40*a*, 40*b* to sheet receiving positions spaced a sufficient distance apart from the center reference Sx so as not to interfere with carry-in of the sheet to the processing tray 29, and shifts the forward/backward rotation roller 31 to the waiting position (i.e. sheet receiving position) (step St2).

Figure 16A:
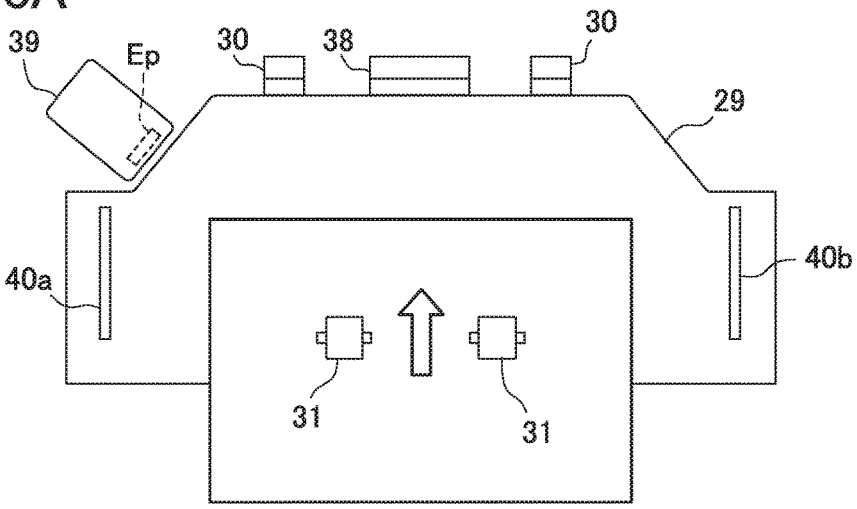
FIGS. 16A to 16E contain schematic explanatory views in viewing, from above the processing tray, steps of performing binding processing on a sheet bunch obtained by collecting sheets carried onto the processing tray, where

Next, when it is detected that the rear end of the sheet passes through the sheet discharge roller 26 with the sheet discharge sensor S2 provided near the sheet discharge outlet 24 (step St3), after a lapse of predicted time the sheet front end arrives at the position of the driven roller 32 (i.e. position of the forward/backward rotation roller 31 in the actuation position) of the processing tray 29, as shown in FIG. 16A, the post-processing control section 52 moves the forward/backward rotation roller 31 down from the upper waiting position to the actuation position for contacting the sheet on the processing tray 29 (step St4), rotates the forward/backward rotation roller 31 a predetermined amount counterclockwise in FIG. 3, and feeds the sheet toward the regulating member 30 on the processing tray 29 (step St5). At this point, the take-in rotating body 33 is also rotated counterclockwise in FIG. 3, and as shown in FIG. 16B, the sheet is transported until the side on the front side of the sheet in the travel direction comes into contact with the regulating member 30.

Figure 16B:
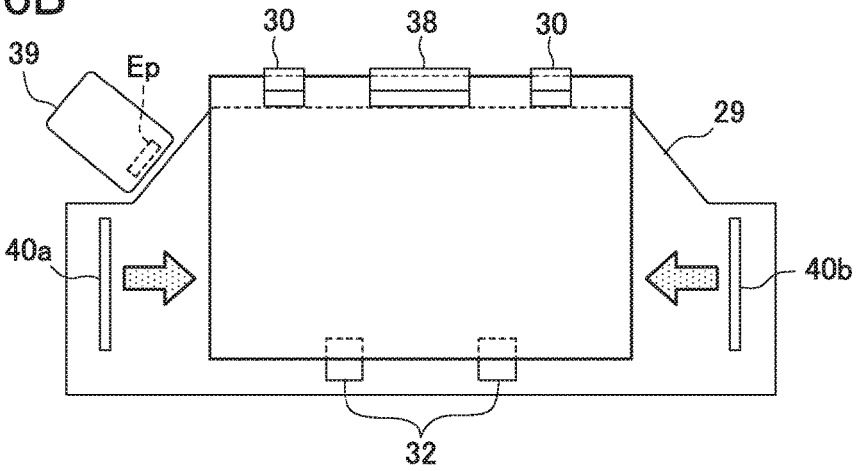
Figure 16C:
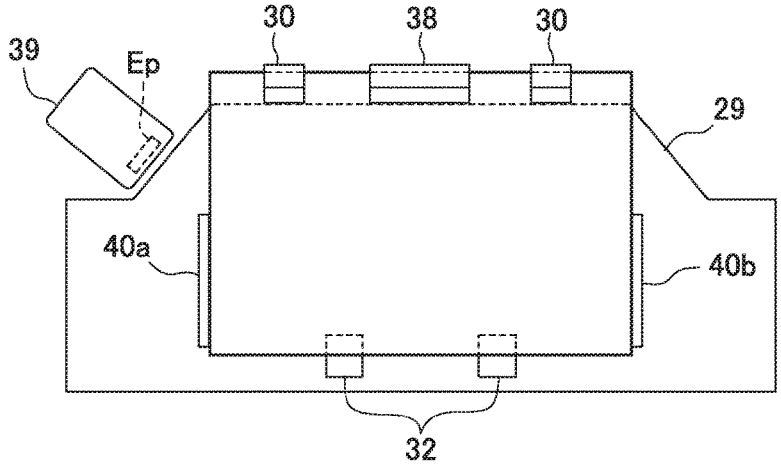

When carry-in of the sheet to the processing tray 29 is halted by contact of the sheet with the regulating member 30, the post-processing control section 52 moves the forward/backward rotation roller 31 up to the waiting position to halt (step St6), and shifts the alignment members 40*a*, 40*b* inward from the receiving positions shown in FIG. 16B so as to nip the sheet from opposite sides in the width direction (step St7). The alignment members 40*a*, 40*b* bring respective regulating surfaces 40*x* into contact with sides (i.e. two sides facing the width direction) on opposite sides in the width direction of the sheet, and are shifted to positions that a separate distance between both of the regulating surfaces 40*x* coincides with the width dimension of the sheet. By this means, as shown in FIG. 16C, each sheet is aligned so that its center in the width direction coincides with the center reference Sx of the processing tray 29. Until a predetermined number of sheets bound as a single sheet bunch are aligned and collected on the processing tray 29 as described above, the above-mentioned steps St1 to St7 are repeated (step St8).

Figure 16D:
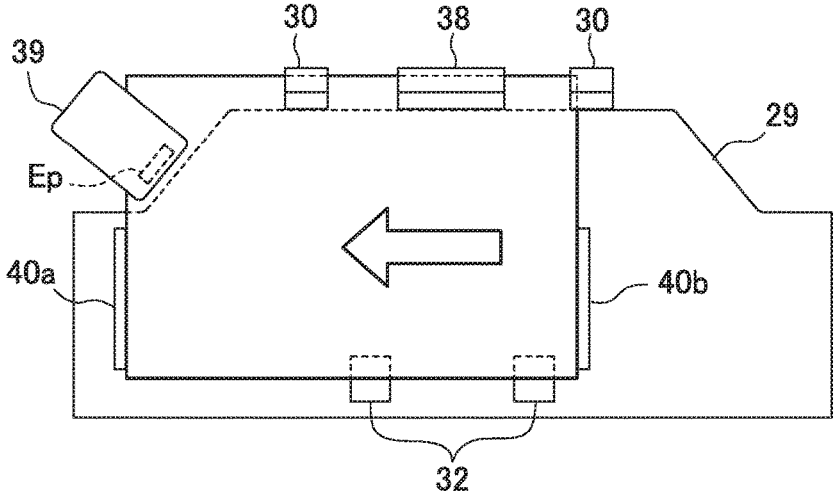
Figure 16E:
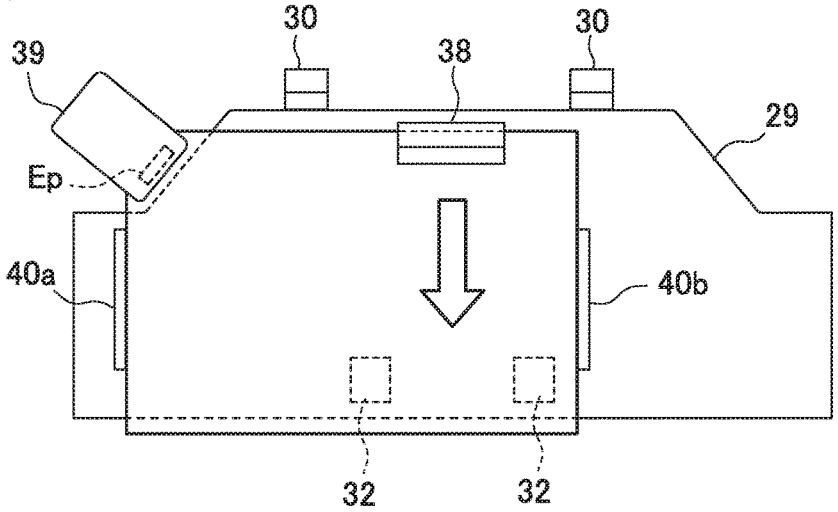

When a predetermined number of sheets are aligned and collected on the processing tray 29, the post-processing control section 52 drives the alignment members 40*a*, 40*b* and push-out lever 38, and shifts the sheet bunch obtained by collecting the sheets to the binding processing position (step St9). In the Embodiment shown in the figure, first, as shown in FIG. 16D, the post-processing control section 52 does not return the alignment members 40*a*, 40*b* to the receiving positions, and offset-shifts by a predetermined offset amount toward the binding processing position Ep side in the width direction, while nipping the sheet bunch from the opposite sides in the width direction. At this point, the alignment members 40*a*, 40*b* are halted in positions in which the side on the apparatus back side of the sheet bunch passes over the binding processing position Ep slightly in the width direction. In the state shown in FIG. 16D, the side on the apparatus back side of the sheet bunch is disposed between separated press tooth members 39*b*, 39*c* of the needleless binding apparatus 39, while being sufficiently spaced apart from the press tooth members 39*b*, 39*c*. In this state, the post-processing control section 52 drives the conveyer apparatus 44 to shift the push-out lever 38 in the carrying-out direction (direction for carrying out from the processing tray 29), and pushes the sheet bunch in the carrying-out direction to shift by a predetermined distance in the carrying-out direction. The push-out lever 38 halts the side of the sheet bunch in a position slightly before the binding processing position Ep in the carrying-out direction. By this means, as shown in FIG. 16E, the corner portion of the sheet bunch to perform the binding processing is positioned in the binding processing position Ep.

When the corner portion of the sheet bunch is positioned in the binding processing position Ep, the post-processing control section 52 issues a command signal, and drives the needleless binding apparatus 39 to cause the apparatus to execute the press binding processing (step St10). By this means, the needleless binding apparatus 39 pressurizes and deforms the corner portion of the sheet bunch between a pair of meshed press tooth members 39*b*, 39*c* in the corrugated shape in cross section shown in FIG. 6C to bind. After the press binding processing, the needleless binding apparatus 39 separates a pair of press tooth members 39*b*, 39*c*, and issues a processing end signal to the post-processing control section 52.

Different Embodiment

When the press binding processing is finished, the post-processing control section 52 drives the peeling mechanism comprised of the push-out lever 38 and side alignment mechanism 37 as the push-out members, performs the peeling processing for peeling the corner portion of the sheet bunch in intimate contact with one of separated press tooth members 39*b*, 39*c* away from the press tooth member 39*b* or 39*c* (step St11), then drives the sheet bunch carrying-out mechanism comprised of the push-out lever 38 and the forward/backward rotation roller 31, and performs the sheet bunch carrying-out processing for carrying out the sheet bunch subjected to the press binding processing from the processing tray 29 to the first stack tray 21 (step St12). The peeling processing and sheet bunch carrying-out processing will be described below in detail.

[Peeling Processing and Sheet Bunch Carrying-Out Processing]

In the press binding processing, since the sheet bunch is pressed strongly against a pair of press tooth members 39*b*, 39*c* having press teeth, the sheet bunch bites into one of a pair of press tooth members 39*b*, 39*c* to be in an intimate contact state, and when the sheet bunch is carried out forcibly in this state, there is the risk that binding is weak, and that failure occurs in the transport mechanism and sheet. Therefore, in the sheet bunch processing apparatus B according to the present invention, after performing the peeling processing using the peeling mechanism subsequent to the press binding processing, the sheet bunch is carried out from the processing tray 29. Further, using two push-out members capable of applying forces in linear independent directions (i.e. non-parallel directions) to the sheet bunch, the peeling mechanism adjusts the action direction of the resultant force of forces applied to the sheet bunch subjected to the press binding processing respectively from two push-out members so as to decrease resistance of the sheet bunch bitten into the press teeth of the press tooth members 39*b*, 39*c* to the press teeth, and is configured to thereby peel the sheet bunch away from the press teeth by a small force. In this Embodiment, as two push-out members capable of applying forces in linear independent directions to a sheet bunch, used are the push-out lever 38 driven in the carrying-out direction and the alignment member 40*a* driven in the width direction. However, as long as the push-out member of the peeling mechanism is capable of applying linear independent forces to a sheet bunch, the push-out member is not limited to the push-out lever 38 and alignment member 40*a*, and for example, another member may be provided which is capable of shifting in the same directions as in the push-out lever 38 and alignment member 40*a*.

Figure 17A:
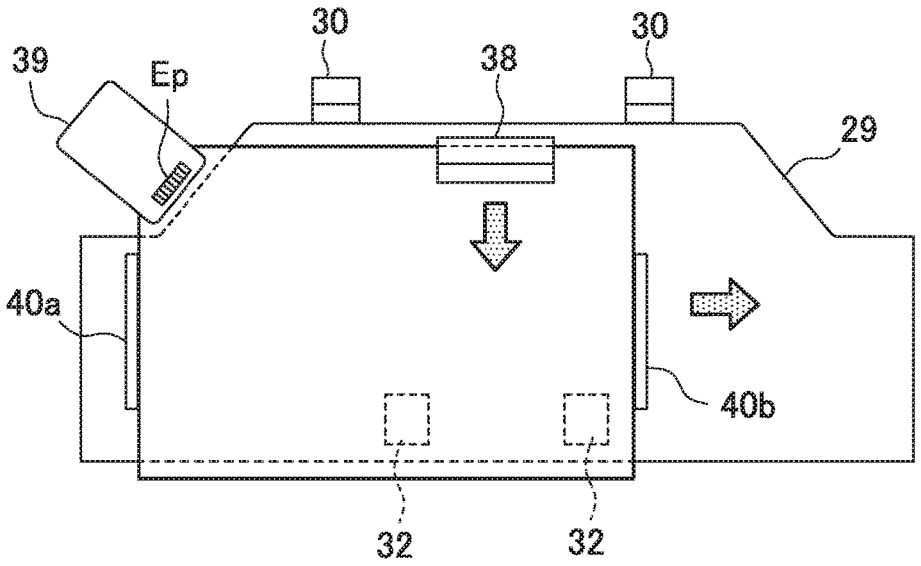
FIGS. 17A to 17D contain schematic explanatory views in viewing, from above the processing tray, steps of operation for peeling the sheet bunch away from press tooth members, and operation for carrying out the sheet bunch from the processing tray to the stack tray, where
Figure 17B:
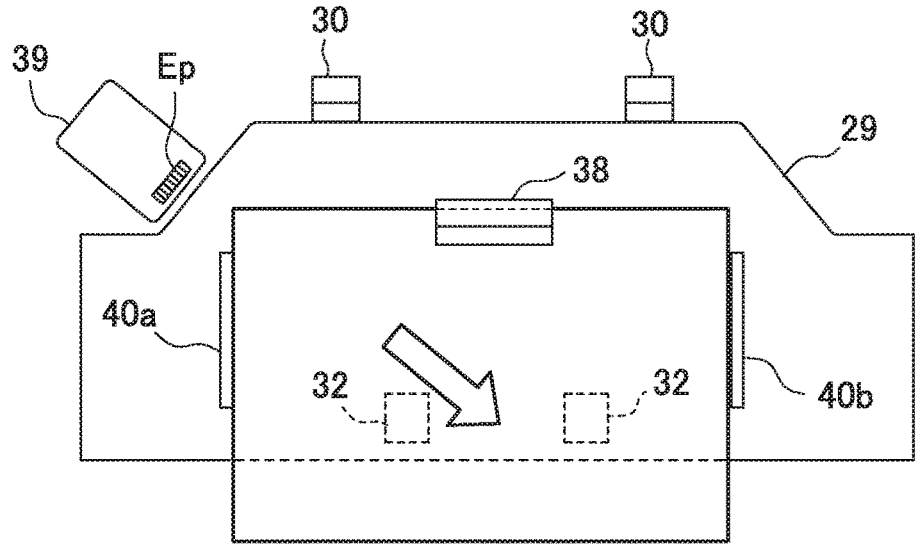

When the press binding processing is finished, as shown in FIG. 17A, in a state in which the push-out lever 38 and alignment members 40*a*, 40*b* are brought into contact with adjacent different sides of the sheet bunch, the post-processing control section 52 drives the conveyer apparatus 44 to shift the push-out lever 38 in the carrying-out direction, and drives the drive motors Ma, Mb to offset-shift the alignment members 40*a*, 40*b* in the direction for separating from the needleless binding apparatus 39 in the width direction (direction perpendicular to the carrying-out direction), while keeping a state in which the members are spaced apart from each other by the sheet width (step St21). By this means, forces are applied to the sheet bunch, so that the force action axis line extending in the action direction of the resultant force of the force applied to the sheet bunch from the push-out lever 38 and forces applied to the sheet bunch from the alignment members 40*a*, 40*b* is toward the direction for decreasing resistance of the sheet bunch bitten into the press teeth of the press tooth members 39*b*, 39*c* to the press teeth, and the sheet bunch is shifted with respect to the needleless binding apparatus 39. In this Embodiment, in order to minimize resistance of the sheet bunch to the press tooth members 39*b*, 39*c*, the post-processing control section 52 controls operation of the push-out lever 38 and alignment members 40*a*, 40*b*, so that the action axis line of the resultant force of the force applied by the push-out lever 38 coming into contact with the side on the rear side of the sheet bunch in the carrying-out direction, and forces applied by the alignment members 40*a*, 40*b* coming into contact with the sides facing the width direction of the sheet bunch extends in the direction parallel with the ridge-line direction of each of the press teeth of the press tooth members 39*b*, 39*c*. By this means, as shown in FIG. 17B, the sheet bunch is shifted in the ridge-line direction of the press teeth of the press tooth members 39*b*, 39*c* with respect to the needleless binding apparatus 39, and it is possible to perform peeling of the sheet bunch away from the press tooth members 39*b*, 39*c* by a small force.

In this Embodiment, in the peeling processing, the force in the width direction is applied to a sheet bunch by offset-shifting a pair of alignment members 40*a*, 40*b* in the width direction of the sheet bunch, while keeping a distance therebetween at a sheet width. However, it is essential only that the alignment member is capable of applying a force in the width direction (i.e. non-parallel) linearly independent of the force in the carrying-out direction applied to the sheet bunch from the push-out lever 38, and the force may be applied to the sheet bunch only by one alignment member 40*a*. In this case, for example, after first separating the alignment member 40*b* in the width direction from the side end edge of the sheet bunch, the alignment member 40*a* is shifted in the width direction toward the alignment member 40*b*.

Figure 17C:
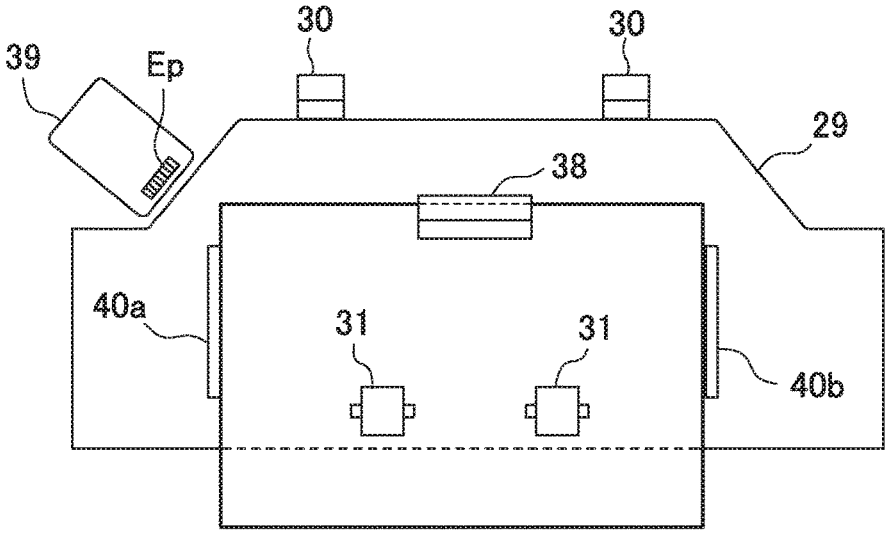
Figure 17D:
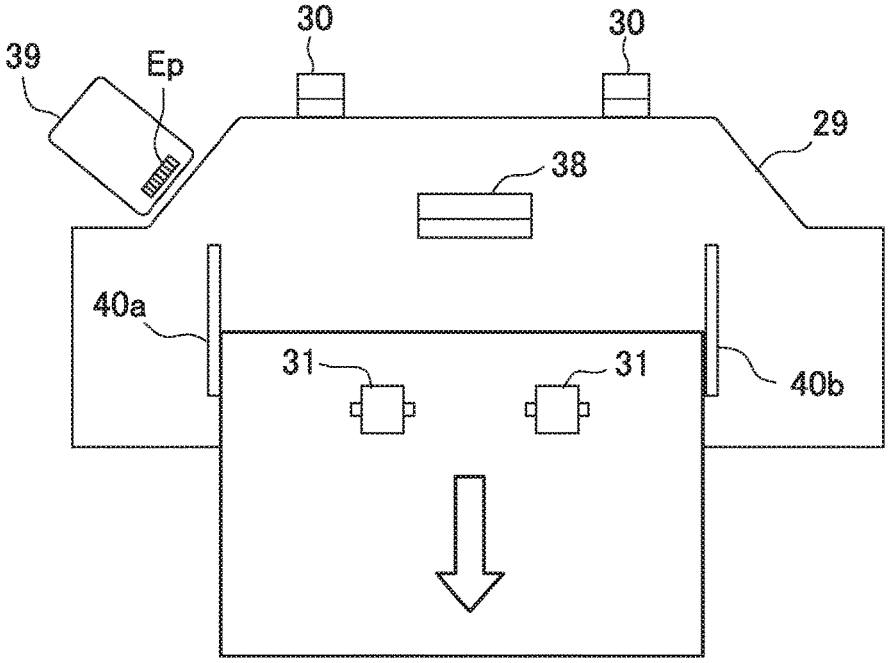

When the peeling processing is completed, the post-processing control section 52 halts the shifts of the push-out lever 38 and the alignment members 40*a*, 40*b* (step St22). It may be configured that even after completing the peeling processing and halting the shifts of the alignment members 40*a*, 40, the push-out lever 38 is further shifted in the carrying-out direction, and that using the push-out lever 38 as the sheet bunch carrying-out mechanism, the sheet bunch is carried out from the processing tray 29. In this case, the push-out lever 38 functions as the sheet bunch carrying-out mechanism for carrying out the sheet bunch form the processing tray 29. Next, as shown in FIG. 17C, the post-processing control section 52 moves the forward/backward rotation roller 31 down from the waiting position to the actuation position for contacting the uppermost sheet on the processing tray 29 (step St23). The push-out lever 38 is returned to the initial position shown in FIG. 16A. Further, as shown in FIG. 17D, the post-processing control section 52 rotates the forward/backward rotation roller 31 clockwise in FIG. 3, and thereby carries out the sheet bunch from the processing tray 29 toward the first stack tray 21 (step St24). At this point, in order for the uppermost sheet of the sheet bunch not to slide over the lower sheet, it is preferable that the forward/backward rotation roller 31 is rotated relatively at low speed to feed the sheet bunch gradually toward the first stack tray 21. Thus, the forward/backward rotation roller 31 also functions as the sheet bunch carrying-out mechanism for carrying out the sheet bunch from the processing tray 29.

In addition, as shown in FIG. 17D, in carrying out the sheet bunch with the forward/backward rotation rollers 31, as long as the alignment members 40*a*, 40*b* are in contact with the sides facing the width direction of the sheet bunch, even in the case where the forward/backward rotation rollers 31 contact asymmetrically in positions spaced apart from the center axis line of the sheet bunch, since the opposite end edges of the sheet bunch are regulated by the alignment members 40*a*, 40*b*, a straight posture is maintained with respect to the carrying-out direction.

Next, when the rear end of the sheet bunch in the carrying-out direction passes through the forward/backward rotation roller 31 (step St25), the post-processing control section 52 halts the rotation of the forward/backward rotation roller 31, and completes the sheet bunch carrying-out processing (step St26).

As described above, the sheet bunch processing apparatus, the image formation system provided with the apparatus and the sheet bunch peeling method according to the present invention are described with reference to the Embodiments shown in the drawings, but the present invention is not limited to the above-mentioned Embodiments. For example, it is possible to set the binding position of a sheet bunch and the position of the needleless binding apparatus 39 at different positions with respect to the processing tray 29. Also in this case, by shifting the sheet bunch in the direction for decreasing resistance of the sheet bunch to the press teeth of the press tooth members 39*b*, 39*c* of the needleless binding apparatus 39, as in the above-mentioned Embodiments, it is possible to perform the processing for peeling the sheet bunch away from the press tooth members 39*b*, 39 with ease by a small force.

As described above, the sheet bunch processing apparatus and the image formation system provided with the apparatus according to the present invention are described with reference to the Embodiments shown in the drawings, but the present invention is not limited to the above-mentioned Embodiments. For example, it is possible to set the binding position of a sheet bunch and the position of the needleless binding apparatus 39 at different positions with respect to the processing tray 29. Also in this case, by shifting the sheet bunch in the direction for decreasing resistance of the sheet bunch to the press teeth of the press tooth members 39*b*, 39*c* of the needleless binding apparatus 39, as in the above-mentioned Embodiments, it is possible to perform the processing for peeling the sheet bunch away from the press tooth members 39*b*, 39 with ease by a small force. Further, in the Embodiments as shown in the drawings, as the push-out members of the peeling mechanism, the push-out lever 38 and the alignment member 40*a* are used, but as long as the push-out member is capable of applying two linear independent forces (i.e. forces in non-parallel directions) to a sheet bunch, the push-out member is not limited to the push-out lever 38 and alignment member 40*a*, and for example, another member may be provided which is capable of shifting in the same directions as in the push-out lever 38 and alignment member 40*a*.

The invention claimed is:

1. A sheet bunch processing apparatus, comprising:

a processing tray to obtain a sheet bunch by collecting a plurality of sheets supplied thereto;

a needleless binding apparatus, including a pair of press tooth members where a plurality of press teeth extending in a ridge-line direction is formed parallel, adapted to press a part of the sheet bunch on the processing tray between the pair of press tooth members in a predetermined pressing direction for making a deformed portion on the sheet bunch, and thereby to perform press binding processing; and a peeling mechanism adapted to apply a force in a moving direction substantially parallel with the ridge-line direction of the press teeth to the sheet bunch for performing a sheet bunch moving process, to come into contact with a predetermined portion of the sheet bunch in the pressing direction prior to the sheet bunch moving process, the predetermined portion of the sheet bunch being located downstream in the moving direction with respect to the deformed portion and being at least partly overlapped with the deformed portion in a cross direction crossing to the ridge-line direction and thereby to peel the sheet bunch subjected to the press binding processing away from the press teeth of the press tooth members.

2. The sheet bunch processing apparatus according to claim 1, wherein the peeling mechanism is provided with a roller that rotates about a rotation axis line and that is able to come into contact with and separate from the predetermined portion of the sheet bunch.

3. The sheet bunch processing apparatus according to claim 2, wherein the rotation axis line extends perpendicularly to the ridge-line direction of the press teeth.

4. The sheet bunch processing apparatus according to claim 3, wherein the peeling mechanism further includes a first push-out member and a second push-out member configured to come into contact with adjacent sides of the sheet bunch subjected to the press binding processing to apply forces in linear independent directions, and operation of the first push-out member and the second push-out member is controlled, so that a force action axis line extending in an action direction of a resultant force of a force applied to the sheet bunch from the first push-out member and a force applied to the sheet bunch from the second push-out member is parallel with an axis line extending in the ridge-line direction of the press teeth.

5. The sheet bunch processing apparatus according to claim 4, further comprising:

a carrying-out mechanism for carrying out the sheet bunch peeled from the press teeth of the press tooth members by the peeling mechanism in a carrying-out direction, wherein the first push-out member is adapted to come into contact with a side of the sheets facing a direction perpendicular to the carrying-out direction to align the sheet bunch in a beforehand determined posture, and the second push-out member is adapted to come into contact with a side of the sheet bunch positioned on an upstream side in the carrying-out direction.

6. The sheet bunch processing apparatus according to claim 2, wherein the roller of the peeling mechanism includes a shift roller capable of rotating about the rotation axis line and shifting in the rotation axis line direction, and a rotation and a shift of the shift roller are controlled so that a force action axis line extending in an action direction of a resultant force of a force applied to the sheet bunch by the rotation of the shift roller about the rotation axis line and a force applied to the sheet bunch by the shift of the shift roller in the rotation axis line direction is parallel with an axis line extending in the ridge-line direction of the press teeth.

7. The sheet bunch processing apparatus according to claim 6, wherein a rotation shaft of the shift roller extending in the rotation axis line direction is shifted in the rotation axis line direction, using a rack-and-pinion mechanism.

8. The sheet bunch processing apparatus according to claim 6, further comprising:

a carrying-out mechanism for carrying out the sheet bunch peeled from the press teeth of the press tooth members by the peeling mechanism in a carrying-out direction, wherein the shift roller is disposed so that the rotation axis line extends perpendicularly to the carrying-out direction, halts the shift after peeling the sheet bunch away from the press teeth, and carries out the sheet bunch in the carrying-out direction by the rotation about the rotation axis line.

9. The sheet bunch processing apparatus according to claim 2, wherein the peeling mechanism further includes a first push-out member and a second push-out member configured to come into contact with adjacent sides of the sheet bunch subjected to the press binding processing to apply forces in linear independent directions, and operation of the first push-out member and the second push-out member is controlled, so that a force action axis line extending in an action direction of a resultant force of a force applied to the sheet bunch from the first push-out member and a force applied to the sheet bunch from the second push-out member is parallel with an axis line extending in the ridge-line direction of the press teeth.

10. The sheet bunch processing apparatus according to claim 9, further comprising:

a carrying-out mechanism for carrying out the sheet bunch peeled from the press teeth of the press tooth members by the peeling mechanism in a carrying-out direction, wherein the first push-out member is adapted to come into contact with a side of the sheets facing a direction perpendicular to the carrying-out direction to align the sheet bunch in a beforehand determined posture, and the second push-out member is adapted to come into contact with a side of the sheet bunch positioned on an upstream side in the carrying-out direction.

11. The sheet bunch processing apparatus according to claim 1, wherein the peeling mechanism is comprised of a first push-out member and a second push-out member, and the first push-out member and the second push-out member are configured to respectively come into contact with adjacent sides of the sheet bunch subjected to the press binding processing to apply forces in linear independent directions to the sheet bunch.

12. The sheet bunch processing apparatus according to claim 11, further comprising:

a control apparatus adapted to control operation of the sheet bunch processing apparatus, wherein the control apparatus controls operation of the first push-out member and the second push-out member, so that a force action axis line extending in an action direction of a resultant force of a force applied to the sheet bunch from the first push-out member and a force applied to the sheet bunch from the second push-out member is substantially parallel with an axis line extending in the ridge-line direction of the press teeth.

13. The sheet bunch processing apparatus according to claim 12, further comprising:

a carrying-out mechanism for carrying out the sheet bunch peeled from the press teeth of the press tooth members by the peeling mechanism in a carrying-out direction, wherein the first push-out member is adapted to come into contact with a side of the sheet bunch facing a direction perpendicular to the carrying-out direction to align the sheet bunch in a beforehand determined posture, and the second push-out member is adapted to come into contact with a side of the sheet bunch positioned on an upstream side in the carrying-out direction.

14. The sheet bunch processing apparatus according to claim 11, further comprising:

a carrying-out mechanism for carrying out the sheet bunch peeled from the press teeth of the press tooth members by the peeling mechanism in a carrying-out direction, wherein the first push-out member is adapted to come into contact with a side of the sheet bunch facing a direction perpendicular to the carrying-out direction to align the sheet bunch in a beforehand determined posture, and the second push-out member is adapted to come into contact with a side of the sheet bunch positioned on an upstream side in the carrying-out direction.

15. An image formation system comprising:

an image formation apparatus adapted to form an image on a sheet; and the sheet bunch processing apparatus, according to claim 1, adapted to perform press binding processing on the sheet bunch obtained by collecting sheets supplied onto the processing tray from the image formation apparatus to carry out.

* * * * *